US009285758B1

(12) United States Patent
Boettcher et al.

(10) Patent No.: US 9,285,758 B1
(45) Date of Patent: Mar. 15, 2016

(54) POSITIONAL CONTROL FEATURES BETWEEN REPLACEABLE UNITS OF AN ELECTROPHOTOGRAPHIC IMAGE FORMING DEVICE

(71) Applicant: Lexmark International, Inc., Lexington, KY (US)

(72) Inventors: Brian Lester Boettcher, Versailles, KY (US); Jeffrey Alan Abler, Georgetown, KY (US); Paul Douglas Horrall, Lexington, KY (US); Michael David Maul, Lexington, KY (US); Jennifer Marie Murphy, Lexington, KY (US); Joshua Carl Poterjoy, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/576,777

(22) Filed: Dec. 19, 2014

(51) Int. Cl.
*G03G 21/00* (2006.01)
*G03G 21/16* (2006.01)
*G03G 21/18* (2006.01)

(52) U.S. Cl.
CPC ..... *G03G 21/1619* (2013.01); *G03G 21/1647* (2013.01); *G03G 21/185* (2013.01); *G03G 21/1842* (2013.01); *G03G 2221/1884* (2013.01)

(58) Field of Classification Search
CPC ..... G03G 21/185; G03G 21/1803; G03G 21/1821; G03G 21/1842; G03G 21/1864; G03G 21/1619; G03G 21/1647; G03G 2221/183; G03G 2221/1884
USPC ..... 399/111, 113
See application file for complete search history.

(56) References Cited

U.S. PATENT DOCUMENTS

| | | | |
|---|---|---|---|
| 5,066,976 | A | 11/1991 | Kanagawa et al. |
| 5,313,993 | A | 5/1994 | Corby et al. |
| 5,434,655 | A | 7/1995 | Okamura |
| 5,583,612 | A | 12/1996 | Schell et al. |
| 5,758,233 | A | 5/1998 | Coffey et al. |
| 5,819,139 | A | 10/1998 | Harlan et al. |
| 5,842,093 | A | 11/1998 | Tanda |
| 6,115,571 | A | 9/2000 | Kobayashi |
| 6,301,456 | B1 | 10/2001 | Horrall et al. |
| 6,386,681 | B1 | 5/2002 | Askren et al. |
| 6,470,163 | B1 | 10/2002 | Minagawa |

(Continued)

OTHER PUBLICATIONS

U.S. Appl. No. 14/725,224, filed May 29, 2015.

(Continued)

*Primary Examiner* — Robert Beatty
(74) *Attorney, Agent, or Firm* — John Victor Pezdek

(57) ABSTRACT

A replaceable unit for an image forming device having features for aligning the replaceable unit when installed in the image forming device and to ensure alignment between the replaceable unit and a detachable unit attachable to the replaceable unit. End walls support a photoconductive drum and have a first bullet nose, second bullet nose and stop arm used for alignment of the replaceable unit in a frame of the image forming device. Support members are on a top surface of the bottom plate with a top planar surface of one of the support members forming a rotational stop and a datum surface for the detachable unit when attached. A mounting channel in one end wall provides a second datum surface for the detachable unit and a mounting channel in the other provides a deskewing plug to adjust axial alignment between the photoconductive drum and a roll in the detachable unit.

21 Claims, 28 Drawing Sheets

(56) References Cited

U.S. PATENT DOCUMENTS

| | | | | |
|---|---|---|---|---|
| 6,530,399 | B2 | 3/2003 | Nguyen et al. | |
| 6,692,107 | B2 | 2/2004 | Lattuca et al. | |
| 7,133,629 | B2 | 11/2006 | Kita | |
| 7,136,609 | B2 | 11/2006 | Askren et al. | |
| 7,159,973 | B2 | 1/2007 | Buchanan et al. | |
| 7,168,799 | B2 | 1/2007 | Benson et al. | |
| 7,258,558 | B1 | 8/2007 | Dawson et al. | |
| 7,272,336 | B1 | 9/2007 | Dawson et al. | |
| 7,305,204 | B2 | 12/2007 | Carter et al. | |
| 7,366,441 | B2 * | 4/2008 | Hatori | G03G 15/0813 399/113 |
| 7,641,313 | B2 | 1/2010 | LaBar | |
| 7,734,230 | B2 | 6/2010 | Takami | |
| 7,756,441 | B2 * | 7/2010 | Kanno | G03G 21/185 399/114 |
| 7,769,321 | B2 | 8/2010 | Tanaka | |
| 7,831,168 | B2 | 11/2010 | Allen et al. | |
| 7,840,165 | B2 | 11/2010 | Okuda | |
| 7,905,572 | B2 | 3/2011 | Anderson, Jr. et al. | |
| 7,953,347 | B2 | 5/2011 | Dawson et al. | |
| 7,992,982 | B2 | 8/2011 | Scharf et al. | |
| 8,200,126 | B2 | 6/2012 | Chaudhuri et al. | |
| 8,292,411 | B2 | 10/2012 | Anderson, Jr. et al. | |
| 8,342,642 | B2 | 1/2013 | Bailey et al. | |
| 8,401,434 | B2 | 3/2013 | Akaike | |
| 8,567,932 | B2 | 10/2013 | James, III et al. | |
| 8,761,639 | B1 | 6/2014 | Leemhuis et al. | |
| 8,909,095 | B2 * | 12/2014 | Yamane | G03G 15/0893 399/111 |
| 2002/0057317 | A1 | 5/2002 | Cowger et al. | |
| 2003/0053819 | A1 | 3/2003 | Nomura et al. | |
| 2003/0219284 | A1 | 11/2003 | Ishiguro et al. | |
| 2005/0220481 | A1 * | 10/2005 | Yamaguchi | G03G 21/185 399/111 |
| 2005/0265736 | A1 | 12/2005 | Seto et al. | |
| 2006/0013621 | A1 | 1/2006 | Kimura et al. | |
| 2007/0098455 | A1 | 5/2007 | Kuma et al. | |
| 2007/0229619 | A1 | 10/2007 | Sugahara et al. | |
| 2009/0016779 | A1 | 1/2009 | Hwang | |
| 2009/0080909 | A1 | 3/2009 | Usui et al. | |
| 2011/0091222 | A1 | 4/2011 | Kim et al. | |
| 2011/0129252 | A1 | 6/2011 | Oda et al. | |
| 2012/0315066 | A1 | 12/2012 | Dawson et al. | |
| 2013/0147885 | A1 | 6/2013 | Harvey et al. | |
| 2013/0170867 | A1 | 7/2013 | Acosta et al. | |
| 2013/0170868 | A1 | 7/2013 | Acosta et al. | |
| 2013/0209141 | A1 | 8/2013 | Hackney et al. | |
| 2013/0287448 | A1 | 10/2013 | Baker et al. | |
| 2014/0212151 | A1 | 7/2014 | Oda | |
| 2015/0098721 | A1 | 4/2015 | Buchanan et al. | |
| 2015/0098730 | A1 | 4/2015 | Buchanan et al. | |
| 2015/0098731 | A1 | 4/2015 | Leemhuis et al. | |
| 2015/0139688 | A1 | 5/2015 | Leemhuis et al. | |
| 2015/0139698 | A1 | 5/2015 | Leemhuis et al. | |

OTHER PUBLICATIONS

U.S. Appl. No. 14/725,195, filed May 29, 2015.

U.S. Appl. No. 14/576,826, filed Dec. 19, 2014.

* cited by examiner

POSITIONAL CONTROL FEATURES BETWEEN REPLACEABLE UNITS OF AN ELECTROPHOTOGRAPHIC IMAGE FORMING DEVICE

CROSS REFERENCES TO RELATED APPLICATIONS

The present application is related to the following United States Patent Applications filed even date herewith and assigned to the assignee of the present application: U.S. patent application Ser. No. 14/576,805 entitled "ROLL DESKEWING DEVICE FOR AN ELECTROPHOTOGRAPHIC IMAGE FORMING DEVICE"; and U.S. patent application Ser. No. 14/576,826 entitled "POSITIONAL CONTROL FEATURES FOR AN IMAGING UNIT IN AN ELECTROPHOTOGRAPHIC IMAGE FORMING DEVICE".

BACKGROUND

1. Field of the Disclosure

The present disclosure relates generally to image forming devices, and, more particularly, to positional control features of two replaceable units for an electrophotographic image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components are positioned in a first replaceable unit, such as an photoconductor unit (PC unit), while shorter life components are positioned in a second replaceable unit, such as a developer unit, that matingly engages with the first replaceable unit. The combination of the two replaceable units form what is termed as an imaging unit.

The toner supply for the image forming device, which is consumed relatively quickly in comparison with the components housed in the imaging unit, is provided in a reservoir that periodically feeds toner to the developer unit of the imaging unit. In this configuration, the number of components housed in the toner cartridge unit is reduced in comparison with traditional toner cartridges.

It is important that the developer unit be precisely aligned within the PC unit when combining to form the imaging unit. If the developer unit is misaligned with respect to the PC unit, the developer roll providing toner to the PC drum may be skewed leading to uneven toner transfer to the PC drum. Additionally, if the imaging unit is misaligned with respect to the media path or the laser beam, skewing of the latent image on the PC drum or the printed image may occur. These misalignments potentially may result in mechanical and print quality defects. Further, if the developer unit is misaligned, a drive gear on the developer unit may not achieve proper gear mesh with a corresponding drive gear in the PC unit potentially resulting in gear cogging. The same potential problems may occur between the engagement of the imaging unit with the drive sources provided in the imaging device. The developer unit and imaging unit must also be rigidly held in place after it is installed in the image forming device in order to prevent the positional alignment of the develop unit and the PC unit from being disturbed during operation. The requirement for accurate positional control must be balanced with the need to permit a user to easily load and unload the developer unit into and out of the imaging unit and/or the imaging unit into and out of the image forming device. Accordingly, it will be appreciated that precise alignment of the developer unit and the imaging unit and relatively simple insertion and removal of the developer unit into and out of the imaging unit and the insertion and removal of the imaging unit into and out of the image forming device is desired. Also desired would be the ability to compensate for skew between rotational axes of the PC drum in the PC unit and the developer roll in the developer unit caused by tolerance stack up due to part-to-part variations.

SUMMARY

Disclosed is a replaceable unit for an image forming device having multiple internal and external features to ensure alignment of the replaceable unit when installed in the image forming device. The replaceable unit has a frame having a generally rectangular bottom plate and a first and second end plate attached adjacent to respective first and second ends of the bottom plate. The first and second end plates rotatably support a shaft axially extending from each end of a roll or a photoconductive drum that is centered on the rotational axis of the photoconductive drum. A first and a second end cap are removably attached to the respective first and second end plates forming a first and a second end wall. Each end cap has a first bullet nose, a second bullet nose and a stop arm each axially projecting from an outer surface thereof. The second bullet nose has an axially aligned opening therein to receive the respective shaft extending from one end of the roll or photoconductive drum and aligning the rotational axis of the photoconductive drum with the centers of the first bullet noses. The stop arm is positioned between the first and second bullet noses with the first bullet noses of the first and second end caps being in respective axial alignment parallel to the rotational axis of the photoconductive drum. The first and second bullet noses are slidably receivable into corresponding first and second openings in a frame of the image forming device for axially and radially positioning the replaceable unit in the image forming device. When the replaceable unit is installed in the frame of the image forming device, each stop arm on the first and second end caps receives a respective biasing force for biasing the respective first and second bullet noses into contact with a respective support or datum surface provided in the respective corresponding first and second openings in the frame of the image forming device.

A bearing may be provided in each axial opening in each of the second bullet noses centered about the rotational axis of the roll or photoconductive drum. The axial opening in the second bullet nose of the second end cap may extend therethrough allowing the corresponding shaft on the end of the roll or photoconductive drum to extend therethrough for mounting a drive coupler thereon. Each end plate may further include a first boss axially extending from the outer surface that is received in an axially aligned opening on an inner surface of the corresponding end cap and a second boss being received in an axially aligned opening in the second bullet nose.

A first and second support member may be provided on the top surface of the bottom plate positioned inwardly from the first and second end plates, respectively. A top planar surface of one of the first and second support members forms a rotational stop and a datum surface for the detachable unit when a detachable unit is inserted into the replaceable unit. First and second end walls may each have a channel therein and aligned with one another with one channel of the first and second end walls having at least one second datum surface formed therein and the other channel of the first and second end walls having a deskewing plug at the closed end. Each channel is sized to receive a corresponding positioning bearing mounted on a shaft of a roll rotatably mounted on the detachable unit. One of the positioning bearings engages the datum surface and the other positioning bearing engages with the deskewing plug when the detachable unit is attached to the replaceable unit. A spring-biased latch is mounted on each of the first and second end walls adjacent to an entry end of each channel. When engaged, the latches apply respective forces to the corresponding positioning bearings with one of the positioning bearings being in contact with the at least one second datum surface and the other of the positioning bearings being in contact with a camming surface on the deskewing plug. Rotation of the deskewing plug allows the axial alignment between respective rotational axes of the roll or photoconductive drum and the roll in the detachable unit to be adjusted.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Spatially relative terms such as "top", "bottom", "front", "back", "rear" and "side", "under", "below", "lower", "over", "upper", and the like, are used for ease of description to explain the relative positioning of one element to a second element. Terms like "horizontal" and "vertical" are used in a similar relative positioning as illustrated in the figures. These terms are generally used in reference to the position of an element in its intended working position within an image forming device. The terms "left" and "right" are as viewed with respect to the insertion direction of a unit into the image forming device. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description. The articles "a", "an" and "the" are intended to include the plural as well as the singular, unless the context clearly indicates otherwise.

Figure 1:
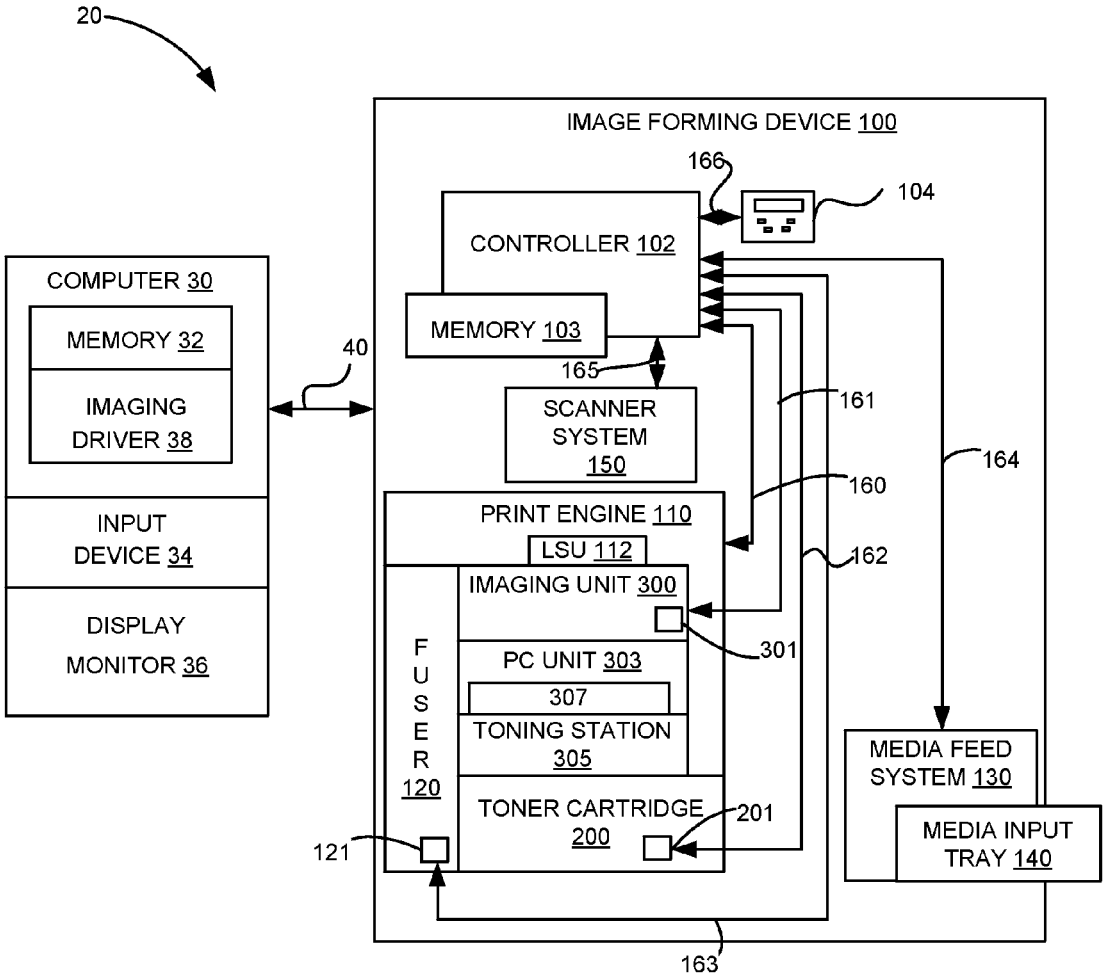
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communication link 40. As used herein, the term "communication link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communication link 160. Controller 102 communicates with imaging unit(s) 300 and processing circuitry 301 on each imaging unit 300 via communication link(s) 161. Imaging unit 300 comprises two replaceable units, photoconductor unit (PC unit) 303 and developer unit 305. PC unit 303 may also include a cleaner assembly 307 for, among other purposes, removing residual toner from the PC drum after toned image transfer has occurred. Controller 102 communicates with toner cartridge(s) 200 and processing circuitry 201 on each toner cartridge 200 via communication link(s) 162. Controller 102 communicates with fuser 120 and processing circuitry 121 thereon via a communication link 163. Controller 102 communicates with media feed system 130 via a communication link 164. Controller 102 communicates with scanner system 150 via a communication link 165. User interface 104 is communicatively coupled to controller 102 via a communication link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communication link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
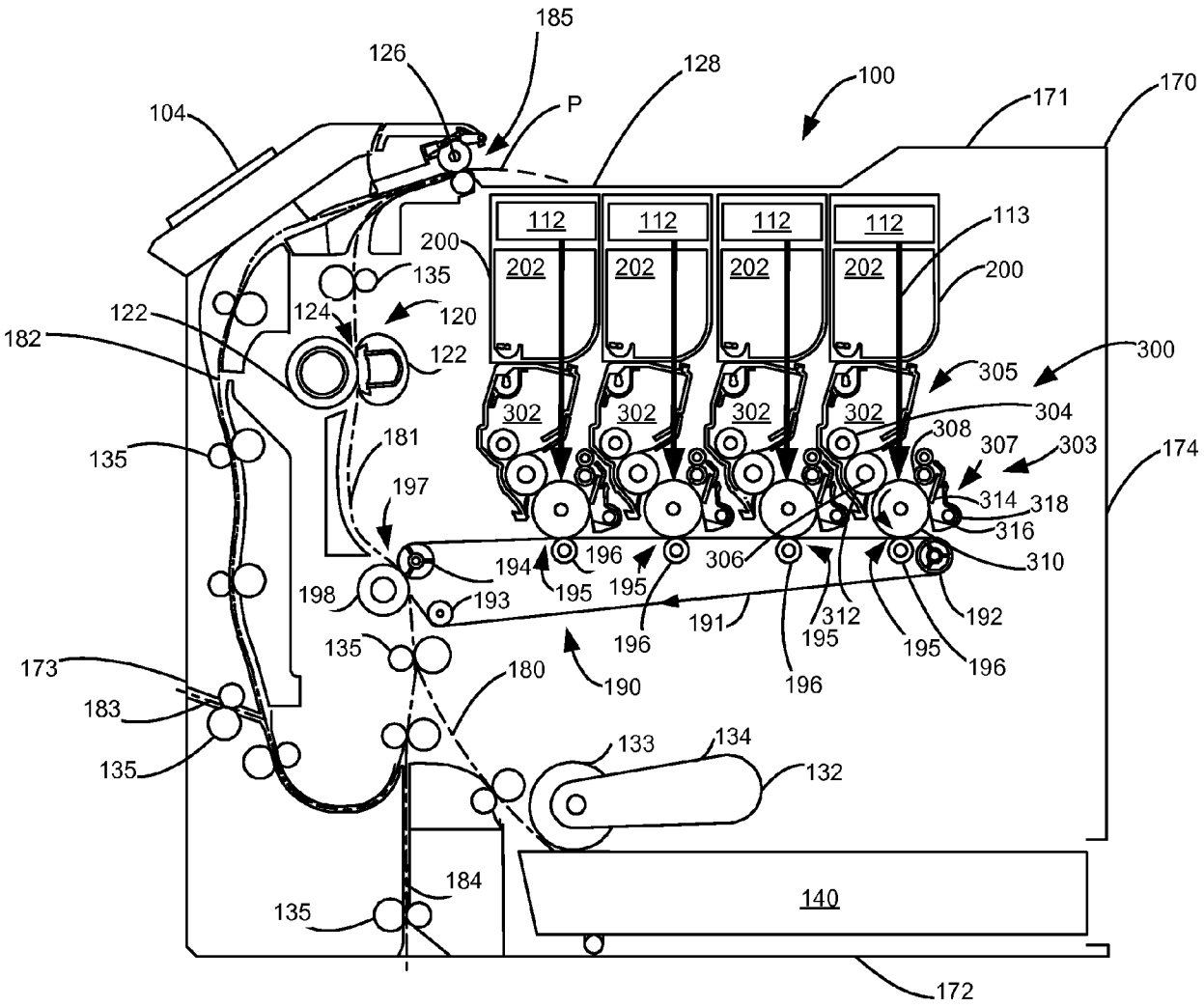
FIG. 2 is a schematic diagram of an image forming device according to a first example embodiment.
Figure 3:
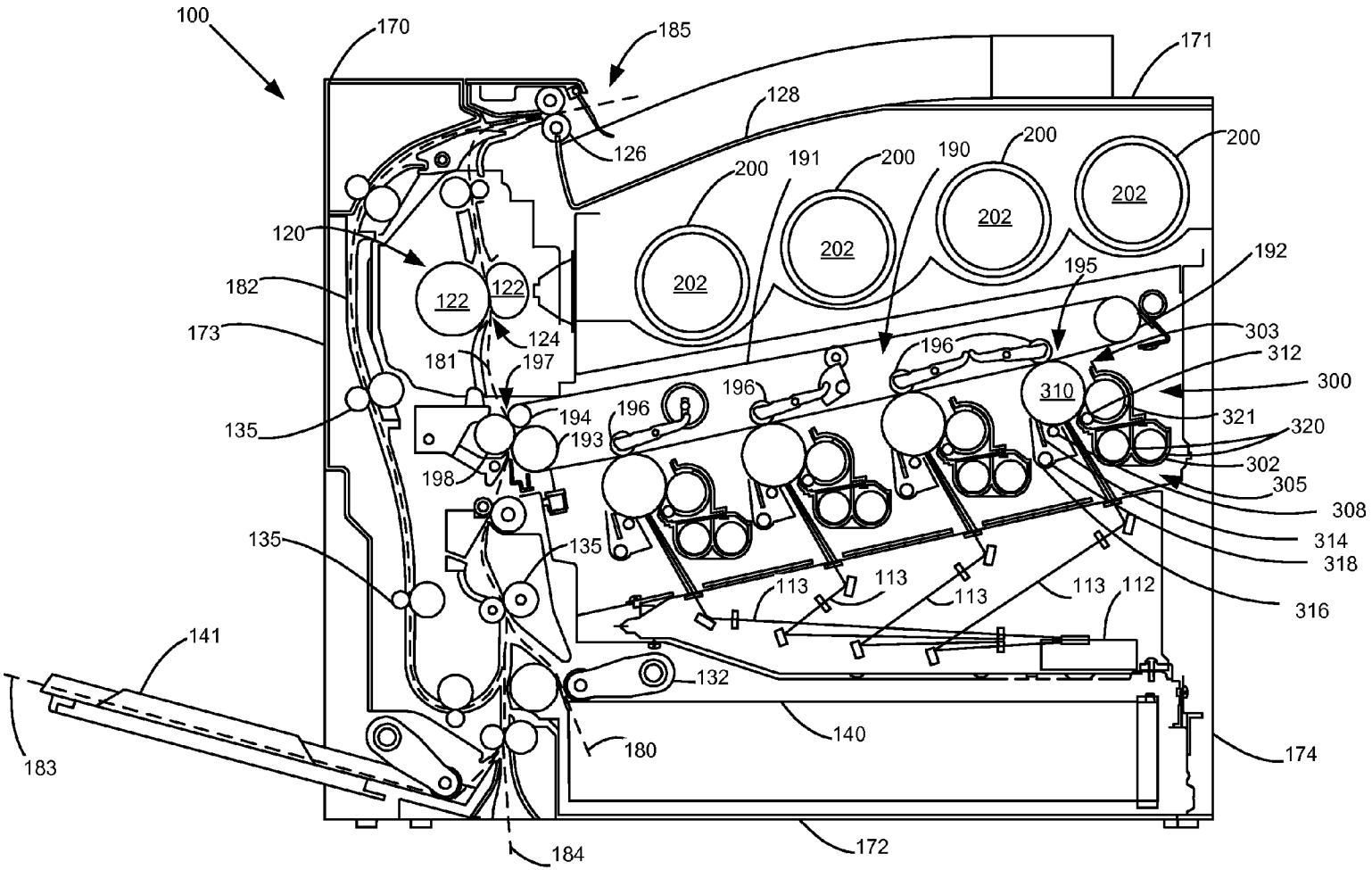
FIG. 3 is a schematic diagram of an image forming device according to a second example embodiment.
Figure 4:
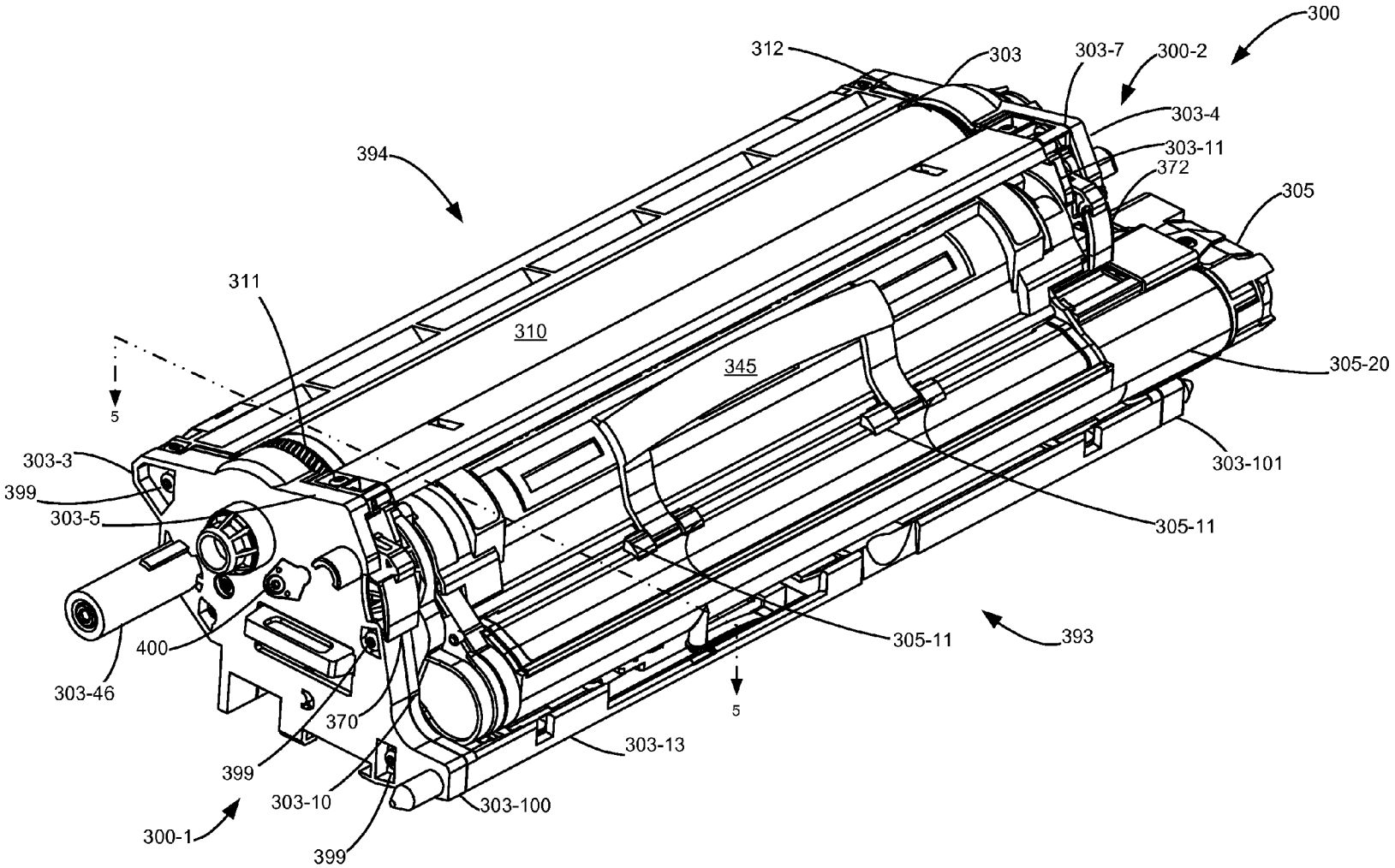
FIG. 4 is a perspective view of an imaging unit for an image forming device.

FIGS. 2-3 illustrate a schematic view of the interior of two example image forming devices 100. For purposes of clarity, the components of only one of the imaging units 300 are labeled in FIGS. 2-3. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Tray 140 is, in one form, removable for refilling. User interface 104 is shown positioned at the front 173 of housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. Simplex path 181 has an exit end 185 at exit rolls 126 from which media is directed to media output area 128. A media sheet is introduced into simplex path 181 from tray 140 by a pick mechanism 132. In the example embodiment shown, pick mechanism 132 includes a roll 133 positioned at the end of a pivotable arm 134. Roll 133 rotates to move the media sheet from tray 140 and into media path 180. The media sheet is then moved along media path 1180 by various transport rollers, generally indicated by reference numeral 135. Media sheets may also be introduced into media path 180 along a manual path 183, such as from a multi-purpose feed tray 141 provided in the front 173 of housing 170, (see FIG. 3) and from a path extension 184 for receiving media being fed from an option assembly (not shown) mounted below the bottom 172 of housing 170. Manual path 183 and path extension 184 each having one of more transport rolls 135. For clarity not all transport rolls 135 are labeled in FIGS. 2-3.

In the example embodiment shown, image forming device 100 includes four toner cartridges 200 removably mounted in housing 170 in a mating relationship with four corresponding imaging units 300 also removably mounted in housing 170. Cartridges 200 and imaging units 300 may be mounted on a frame 500 provided within housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner. Each imaging unit 300 includes PC unit 303 and developer unit 305. Provided in developer unit 305 is a toner reservoir 302 and a toner adder roll 304 that moves toner from toner reservoir 302 to a developer roll 306, typically made of polybutyldiene and a metering device 313. The PC unit 303 includes a charging roll 308, a photoconductive (PC) drum 310, a cleaner blade 314 and a waste toner reservoir 316, PC drums 310 are mounted substantially parallel to each other when the imaging units 300 are installed in image forming device 100. In the example embodiment illustrated, each imaging unit 300 is substantially the same except for the color of toner contained therein. Typically, developer roll 306 and PC drum 310 are axially aligned and form an interference nip therebetween.

Each charging roll 308 forms a nip with the corresponding PC drum 310. During a print operation, charging roll 308 charges the surface of PC drum 310 to a specified voltage such as, for example, −1000 volts. A laser beam 113 from LSU 112 then impinges on the surface of PC drum 310 and selectively discharges those areas it contacts to form a latent image. In one embodiment, areas on PC drum 310 illuminated by the laser beam are discharged to approximately −300 volts. Developer roll 306 then transfers toner to PC drum 310 on the latent image to form a toner image on PC drum 310. A metering device 313, such as a doctor blade assembly 313 may be used to meter toner onto developer roll 306 and apply a desired charge to the toner prior to its transfer to PC drum 310. The toner is attracted to the areas of the surface of PC drum 310 discharged by the laser beam 113 from LSU 112. As the PC drum 310 continues to rotate any residual toner remaining on the surface is removed by cleaner blade 314 and drops into a waste toner reservoir 316 in cleaner assembly 307. A waste toner auger 318 is used to convey the waste toner to a larger waste toner bottle. Thereafter, the cycle of charging, discharging and toner image transfer of PC drum 310 is continuously repeated.

An intermediate transfer mechanism (ITM) 190 is disposed adjacent to the PC drums 310. In this embodiment, ITM 190 includes a transfer member 191, shown as an endless belt 191, trained about a drive roll 192, a tension roll 193 and a back-up roll 194. During image forming operations, transfer member 191 moves past PC drums 310 in a clockwise direction as viewed in FIG. 2. One or more of PC drums 310 apply toner images in their respective colors to ITM 190 at first transfer nips 195 formed between PC drums 310 and transfer member 191. In one embodiment, transfer rolls 196 axially aligned with and positioned tangent to PC drums 310 beneath transfer member 191 apply a positive voltage field to attract the toner image from PC drums 310 to the surface of the moving transfer member 191. Transfer member 191 rotates and collects the one or more toner images from PC drums 310 and then conveys the toner images to a media sheet at a second transfer nip 197 formed between a transfer roll 198 and transfer member 191, which is supported by back-up roll 194.

A media sheet advancing through simplex path 181 receives the toner image from ITM 190 as it moves through the second transfer nip 197. The media sheet with the toner image is then moved along the media path 180 and into fuser 120. Fuser 120 includes fusing rolls or belts 122 that forma nip 124 where pressure and/or heat is used to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to a media output area 128 on top 171 of image forming device 100. In a reverse direction, exit rolls 126 move the media sheet into duplex path 182 which returns the media sheet back to second transfer nip 197 for image formation on a second side of the media sheet.

FIG. 3 illustrates an example embodiment of an image forming device 100 that utilizes what is commonly referred to as a dual component developer system. In this embodiment, image forming device 100 includes four toner cartridges 200 removably mounted in housing 170 and mated with four corresponding imaging units 300 having PC units 303 and developer units 305. Toner is periodically transferred from reservoirs 202 of each toner cartridge 200 to corresponding reservoirs 302 of developer units 305 of imaging units 300. The toner in reservoirs 302 is mixed with magnetic carrier beads using twin augers 320, in lieu of toner adder roll 304, which circulate the mixture in reservoirs 302 along an elliptical path. The magnetic carrier beads may be coated with a polymeric film to provide triboelectric properties to attract toner to the carrier beads as the toner and the magnetic carrier beads are mixed in reservoir 302. In this embodiment, each developer unit 305 includes a magnetic roll 321, in place of developer roll 306, that attracts the magnetic carrier beads having toner thereon from reservoir 302 onto magnetic rob 321 through the use of a plurality of magnetic fields. The carrier beads are arranged in parallel strips along the length of magnetic roll 3211 and have the appearance of whiskers standing out from the surface of the magnetic roll 321. Again a doctor blade 313 or trim bar 313 or other leveling member may be used of provide a uniform height of the toner covered magnetic bead whiskers. Electrostatic forces from the latent images on the photoconductive drums 310 strip the toner from the magnetic carrier beads to provide a toned image on the surface of the photoconductive drums 310. The toned images are then transferred to transfer member 191 of ITM 190 and then to a media sheet at second transfer nip 197 as discussed above. Again, the PC unit 303 includes a charge roll 308, a pc drum cleaner blade 314, a waste toner reservoir 316 and a waste toner auger 318, as previously described.

While the example image forming devices 100 shown in FIGS. 2-3 illustrate four toner cartridges 200 and four corresponding imaging units 300, it will be appreciated that a monocolor image forming device 100 may include a single toner cartridge 200 and a corresponding imaging unit 300 as compared to a color image forming device 100 that may include multiple toner cartridges 200 and imaging units 300. Further, although image forming devices 100 utilize ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component such as a chute, duct or hopper that interconnects the toner cartridge 200 with its corresponding imaging unit 300.

The positioning and alignment features described in FIGS. 4-33 maybe used with image forming device 100 having imaging unit 300, a PC unit 303 and developer unit 305. For purposes of illustration only, these positioning and alignment features will be illustrated by the image forming device 100 having the imaging unit 300, PC unit 303 and developer unit 305 illustrated in FIG. 3. It will be recognized that these positioning and alignment features may also be used with the imaging unit, PC unit and developer unit illustrated in FIG. 2. For the purposes of the following description, the terms "developer roll" and "magnetic roll" are interchangeable and hereinafter magnetic roll will be used. The front and rear of imaging unit 300, PC unit 303, frame 303-10, developer unit 305 and the various components thereof is generally indicated by reference numerals 393, 394 in the various figures.

Referring now to FIGS. 4-7, imaging unit 300 is composed of developer unit 305 detachably coupled with PC unit 303. Imaging unit 300 has a removal end 300-1 and an insertion end 300-2. The insertion end 300-2 means the end of imaging unit 300 that is first inserted into the frame 500 of imaging device 100 (see FIG. 34). The removal or exit end 300-1 means the end of imaging unit 300 that first leaves frame 500 of imaging device 100 during removal of the imaging unit 300 from imaging device 100. The respective removal and insertion ends 300-1, 300-2 of imaging unit 300 may also be referred to as its first and second ends (left and right ends as viewed in FIG. 4). PC unit 303 and developer unit 305 each respectively have first and second ends 303-1, 303-2 and 305-1, 305-2 corresponding to removal and insertion ends 300-1, 300-2 as may be better viewed in FIGS. 6-7. Imaging unit 300 may also be referred to as a replaceable unit. PC unit 303 and developer unit 305 may also be referred to as a replaceable unit. Developer unit 305 may further be referred to as a detachable unit in that it is detachable from PC unit 303.

A handle 345 is pivotally attached at mounts 305-11 on housing 305-20 of developer unit 305 and is used to assist a user in attaching/detaching developer unit 305 from the frame 303-10 of PC unit 303 and in lifting and carrying imaging unit 300 when developer unit 305 is connected with PC unit 303. Provided on a bottom plate 303-13 of frame 303-10 are first and second end walls 303-3, 303-4 which in turn have first and second latches 370, 372. First end wall 303-3 comprises a first end plate 303-11 depending from bottom plate 303-13 having detachably attached thereto a first end cap 303-100. Second end wall is similarly structured from a second end plate 303-12 and second end cap 303-101. Various alignment features of these end plates and caps will be further described elsewhere in this description with reference to FIG. 25 et seq.

A front portion (as viewed in FIG. 4) of a bottom plate 303-13 of frame 303-10 of PC unit 303 and first and second latches 370, 372 help support developer unit 305 when installed in PC unit 303. When developer unit 305 is installed, magnetic roll 321 and PC drum 310 are axially aligned. At PC unit 303, first and second bearings 326, 327 on respective first and second ends 323, 324 of a shaft 322 of magnetic roll 321 are inserted into and rotatably supported by opposed first and second channels 303-41, 303-42 provided in first and second end walls 303-3, 303-4 at a position adjacent their respective top surfaces 303-5, 303-7 and adjacent to the first and second ends 311, 312 of PC drum 310. First and second ends 331, 332 of shaft 330 of PC drum 310 are similarly rotatably supported in opposed openings 303-43, 303-44 (see FIG. 6) provided in respective first and second end walls 303-3, 303-4 adjacent to where developer unit 305 is inserted. As shown first and second channels 303-41, 303-42 are in approximate horizontal alignment (as viewed) with the respective opposed openings 303-43, 303-44.

Figure 5:
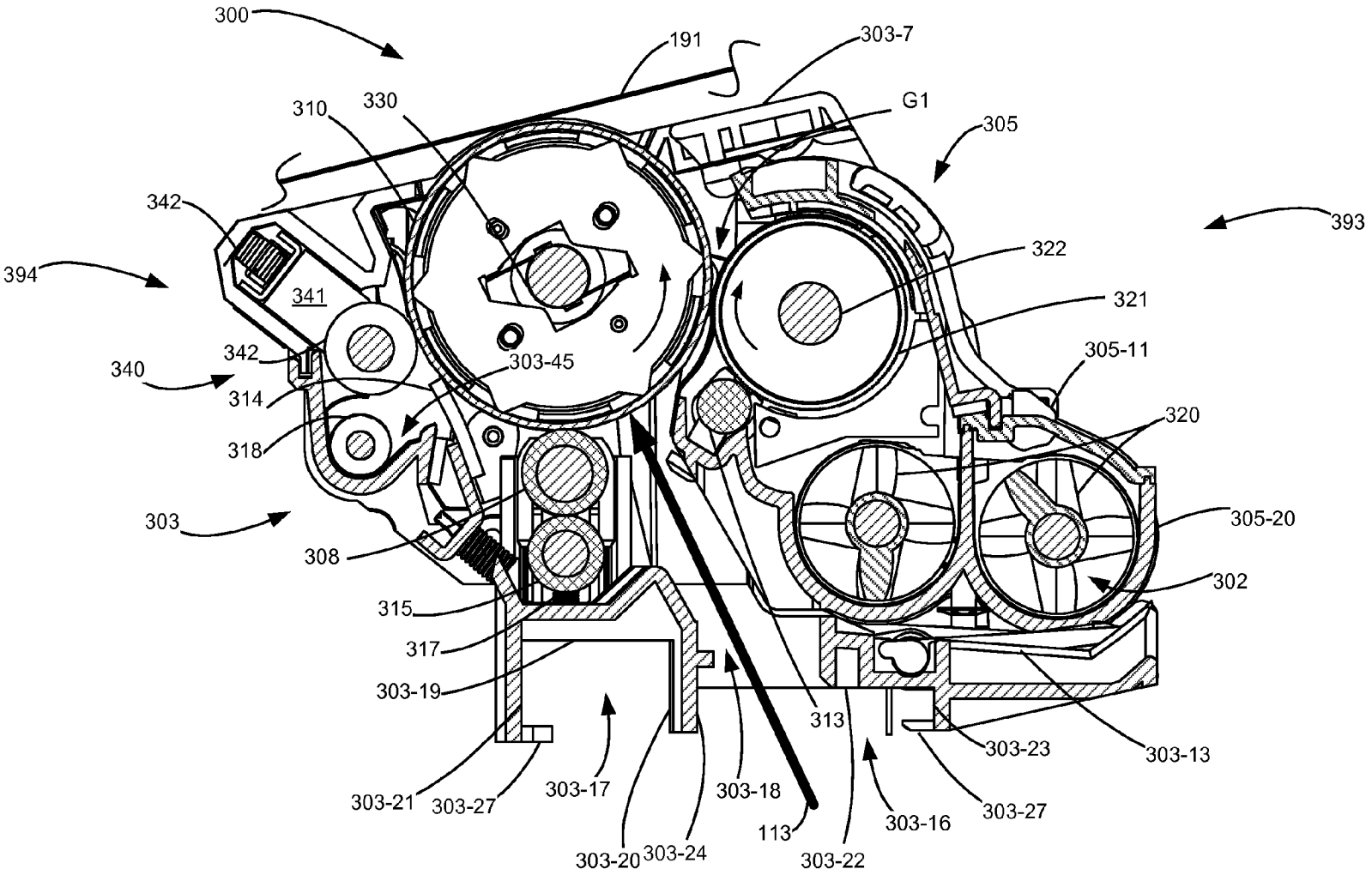
FIG. 5 is a cross-sectional view of the imaging unit of FIG. 4 taken along line 5-5 in FIG. 4.
Figure 6:
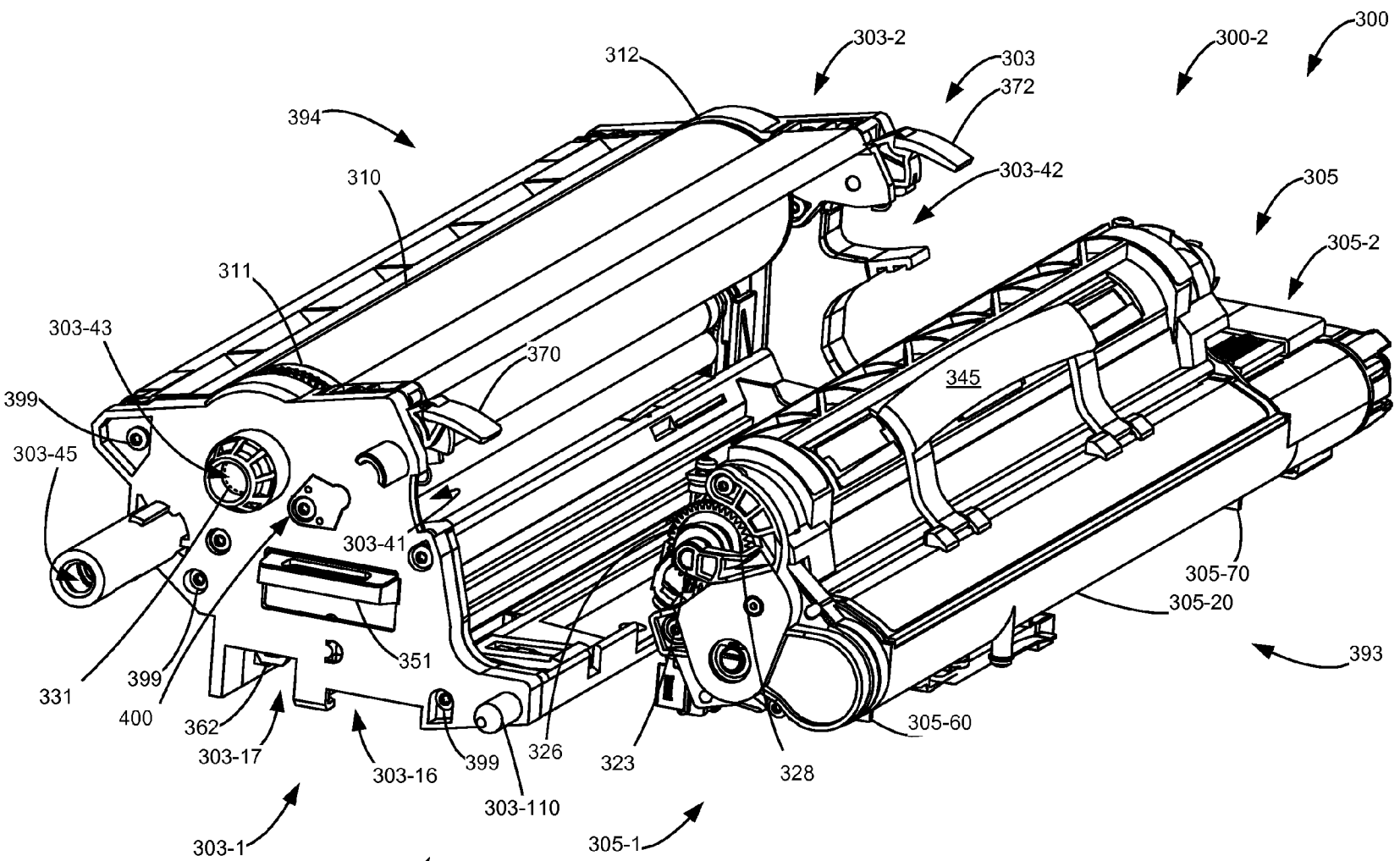
FIG. 6 is a perspective view from a first end of two replaceable units forming an imaging unit, one unit being a photoconductor unit and the other being a developer unit.

As shown in FIG. 5, in the imaging unit 300, PC drum 310 and magnetic roll 321 are positioned immediately adjacent one another and are axial aligned with one another (the axis being perpendicular to the plane of the page) and separated by an axial gap G1. As illustrated, when imaging unit 300 is installed in frame 500, PC drum 310 is positioned below ITM belt 191. Within PC unit 303 is a PC drum coating assembly 340 formed of a block of coating material 341, such as zinc sterate, a transfer brush 342 and a biasing spring 343. Spring 343 biases the block of coating material 341 against transfer brush 342 which when rotated transfers the coating material from block 341 onto PC drum 310. Waste toner auger 318 is shown positioned in a trough 303-45 positioned below transfer brush 342. Charge roll 308 is shown positioned below and in contact with PC drum 310. A charge roll cleaning roll or brush 315 is shown positioned below charge roll 308 and is biased by spring 317 toward charge roll 308. PC drum 310, charge roll 308 and charge roll cleaning roll 315 are illustrated as being in substantial vertical alignment. First and second channels 303-16, 303-17 are provided in a bottom surface 303-15 of bottom plate 303-13 for, among other purposes, aligning imaging unit 300 in frame 500. A window or slot 303-18 is provided in first channel 303-16 through bottom plate 303-13 to allow laser beam 113 to impinge the surface of PC drum 310 along the axial length thereof during laser scanning of the surface of PC drum 310 which creates the latent image to be toned as PC drum 310 is rotated in the direction indicated (anti-clockwise as shown).

In developer unit 305, magnetic roll 321 is shown positioned within an upper section of the housing 305-20. Toner reservoir 302 is formed within a lower portion of housing 305-20 and includes twin parallel augers 320 that circulate a toner-carrier bead mixture within toner reservoir 302. Positioned above toner reservoir 102 and adjacent to magnetic roll 321 is trim bar 313. Magnetic roll 321 attracts toner-carrier bead mixture from toner reservoir 302 and as it rotates in the direction indicated (clockwise as shown), trim bar 313 provides a substantially uniform height of toner-carrier bead mixture. The excess toner and carrier beads fall back into toner reservoir 302 while portions of the toner remaining on magnetic roll 321 will be transferred to the latent image on PC drum 310 as the two rolls rotate past one another. The toned latent image is then transferred to ITM 191.

Figure 7:
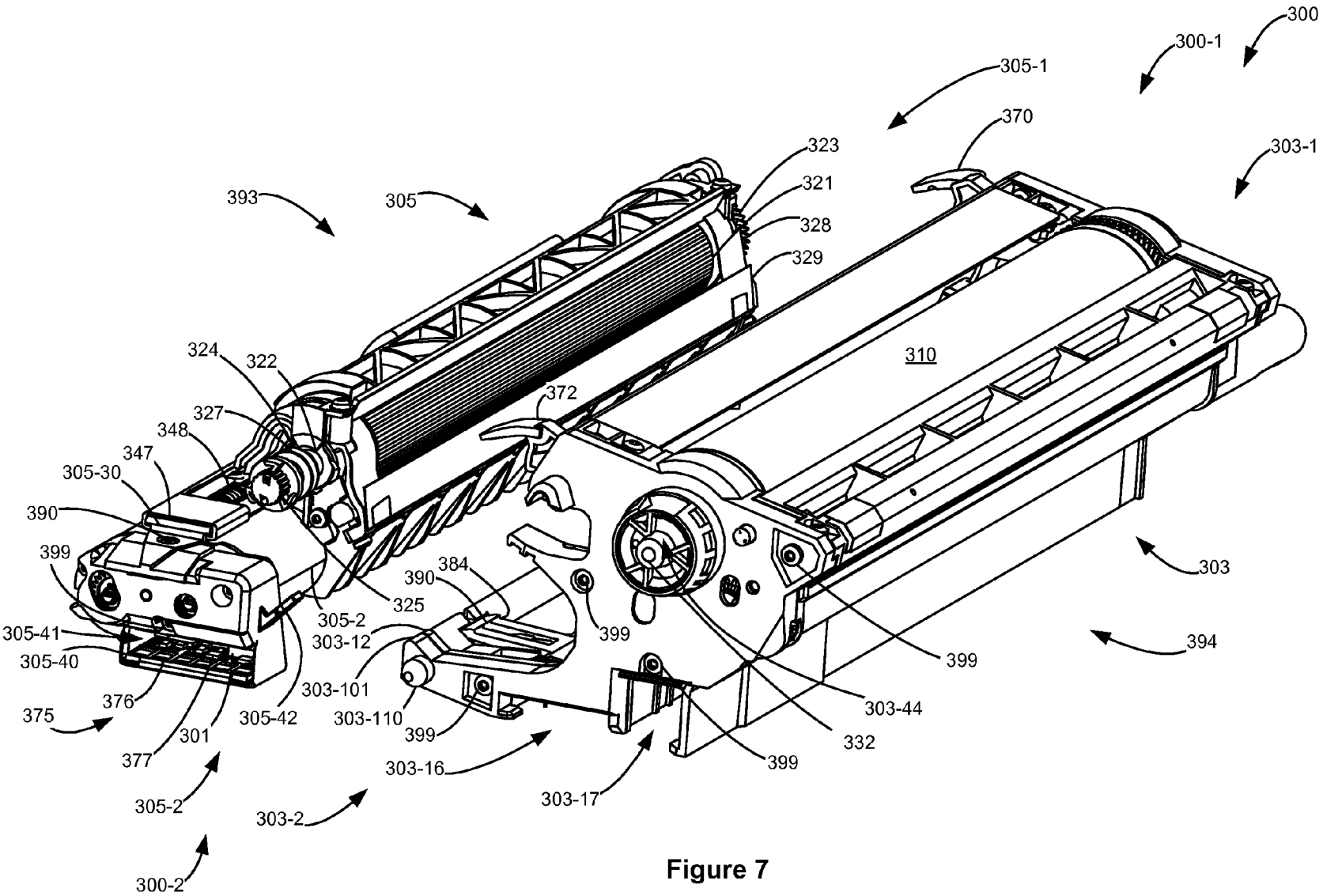
FIG. 7 is a perspective view of two replaceable units of FIG. 6 as viewed from their respective second ends.
Figure 8:
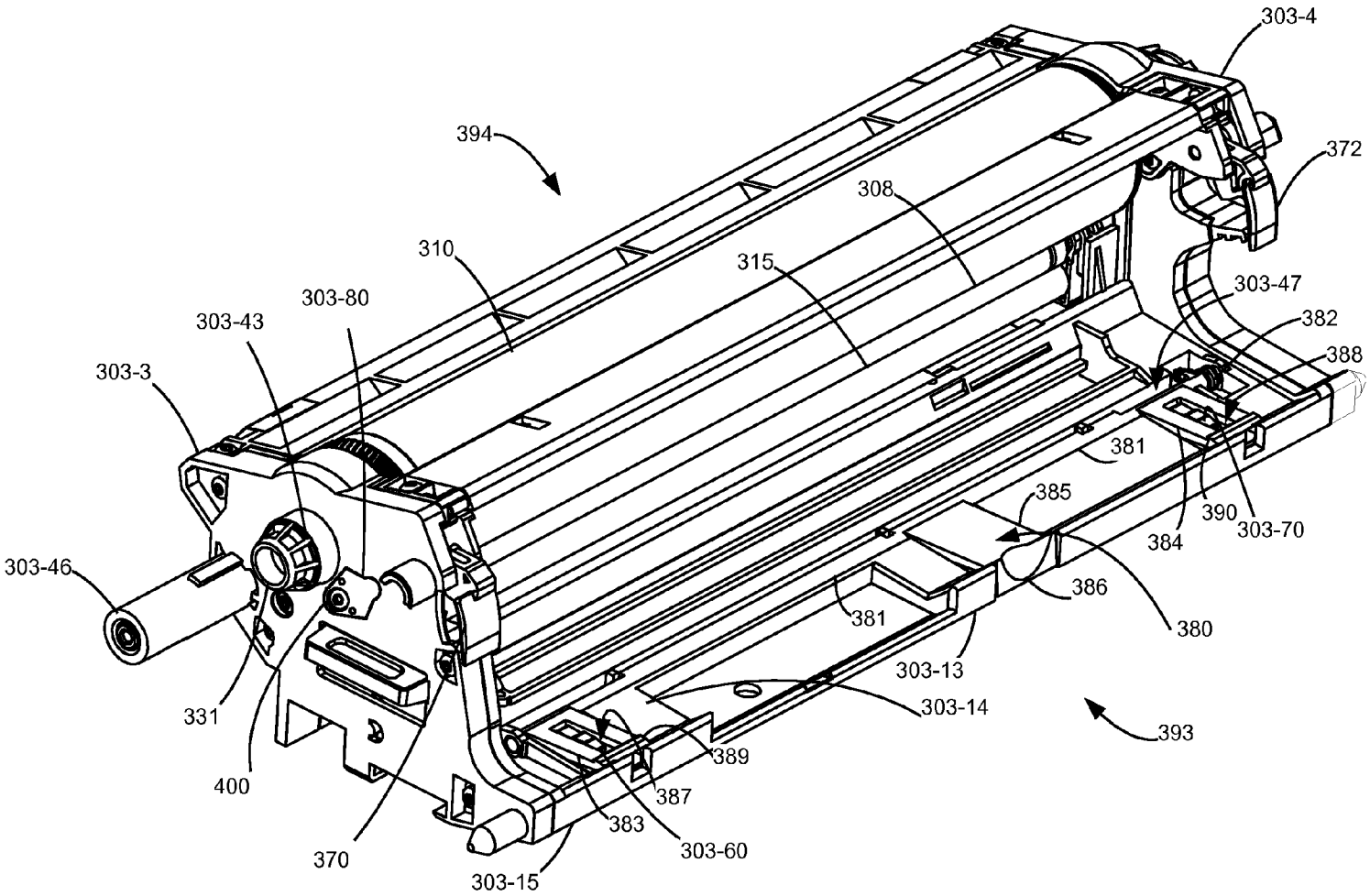
FIG. 8 is a perspective view of a replaceable unit operable as a photoconductor unit viewed from a first end.
Figure 9:
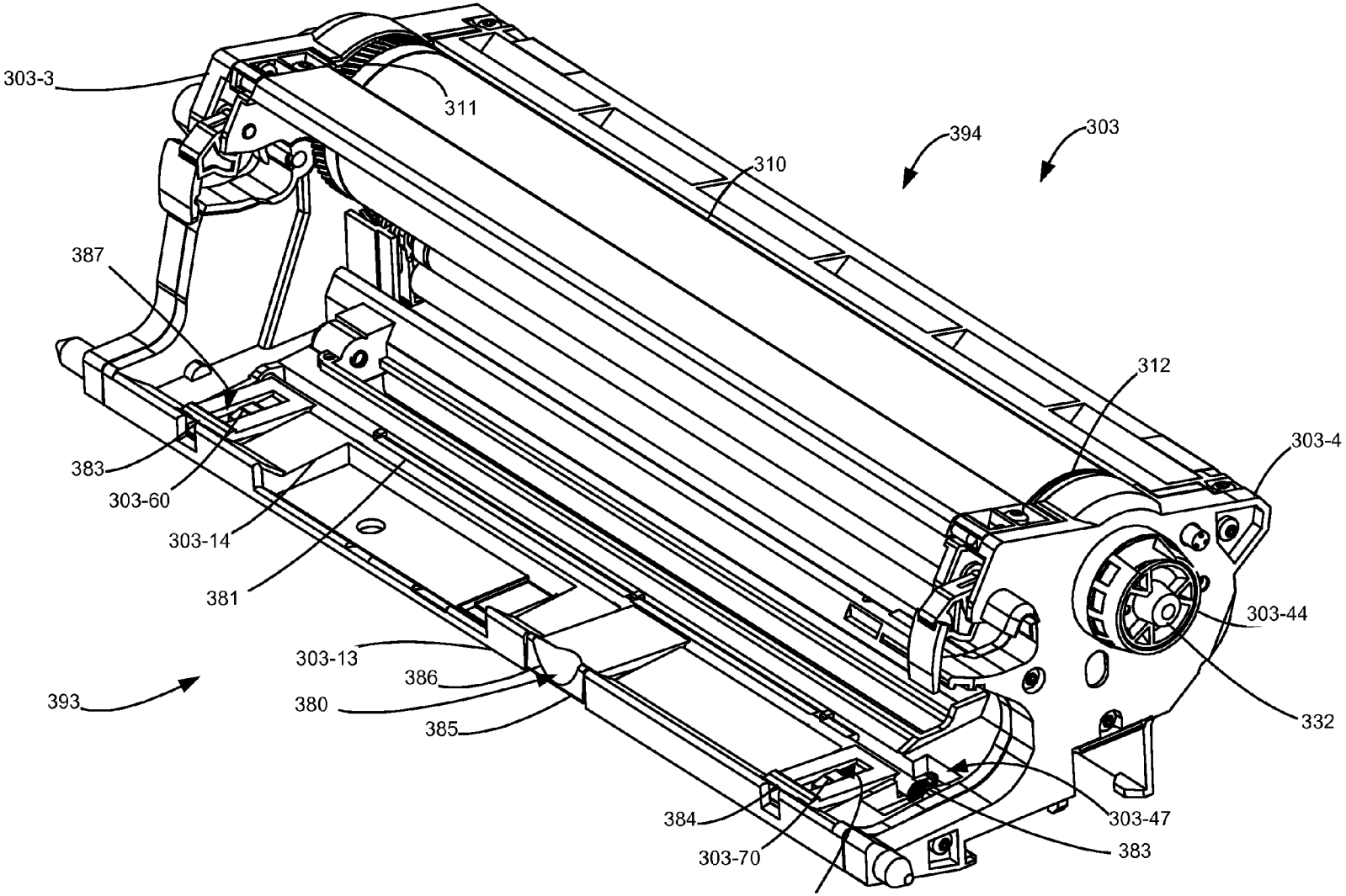
FIG. 9 is a perspective view of the replaceable unit of FIG. 8 as viewed from a second end.
Figure 10:
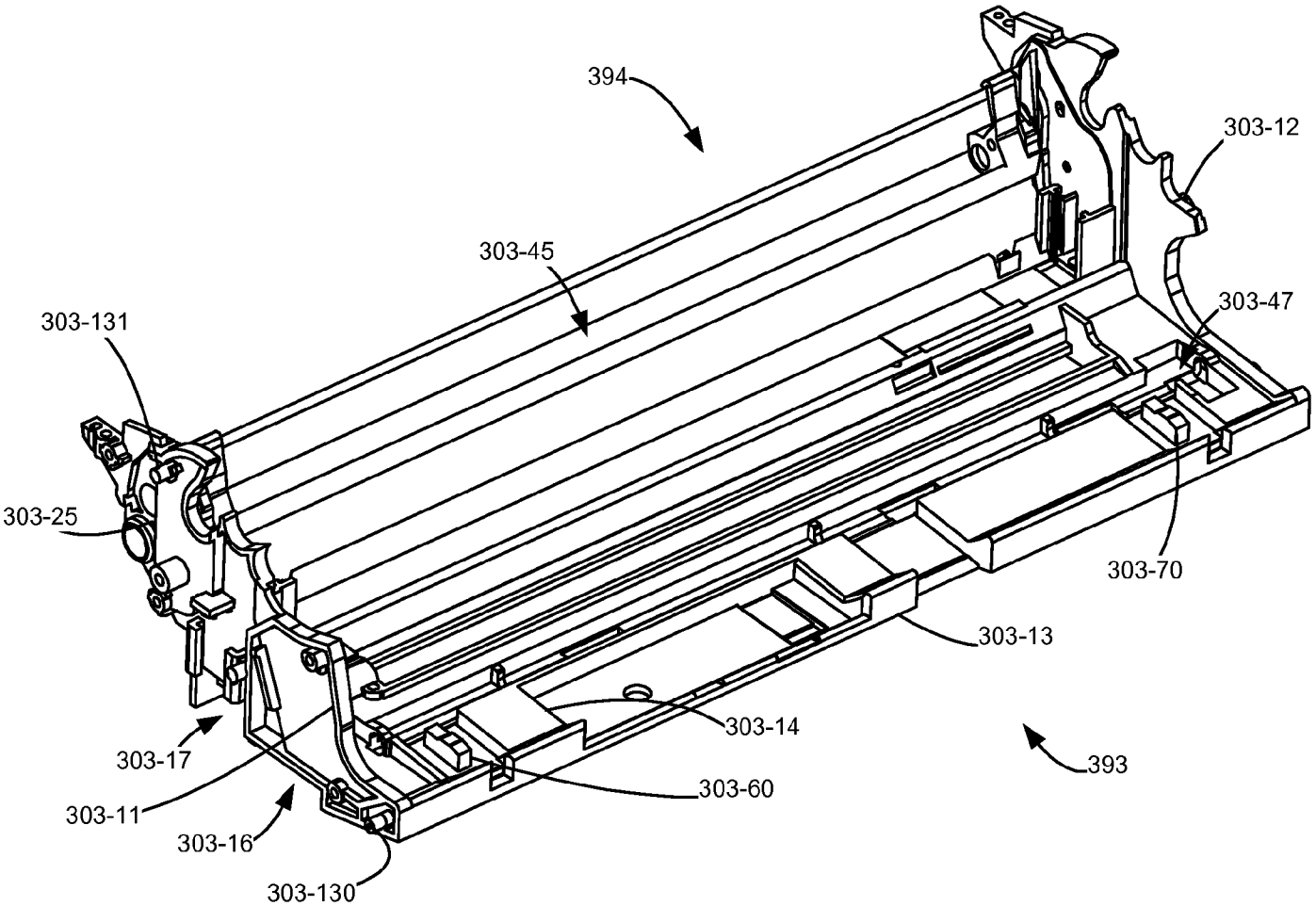
FIG. 10 is a perspective view of the frame of the replaceable unit of FIG. 8 viewed from the first end.
Figure 11:
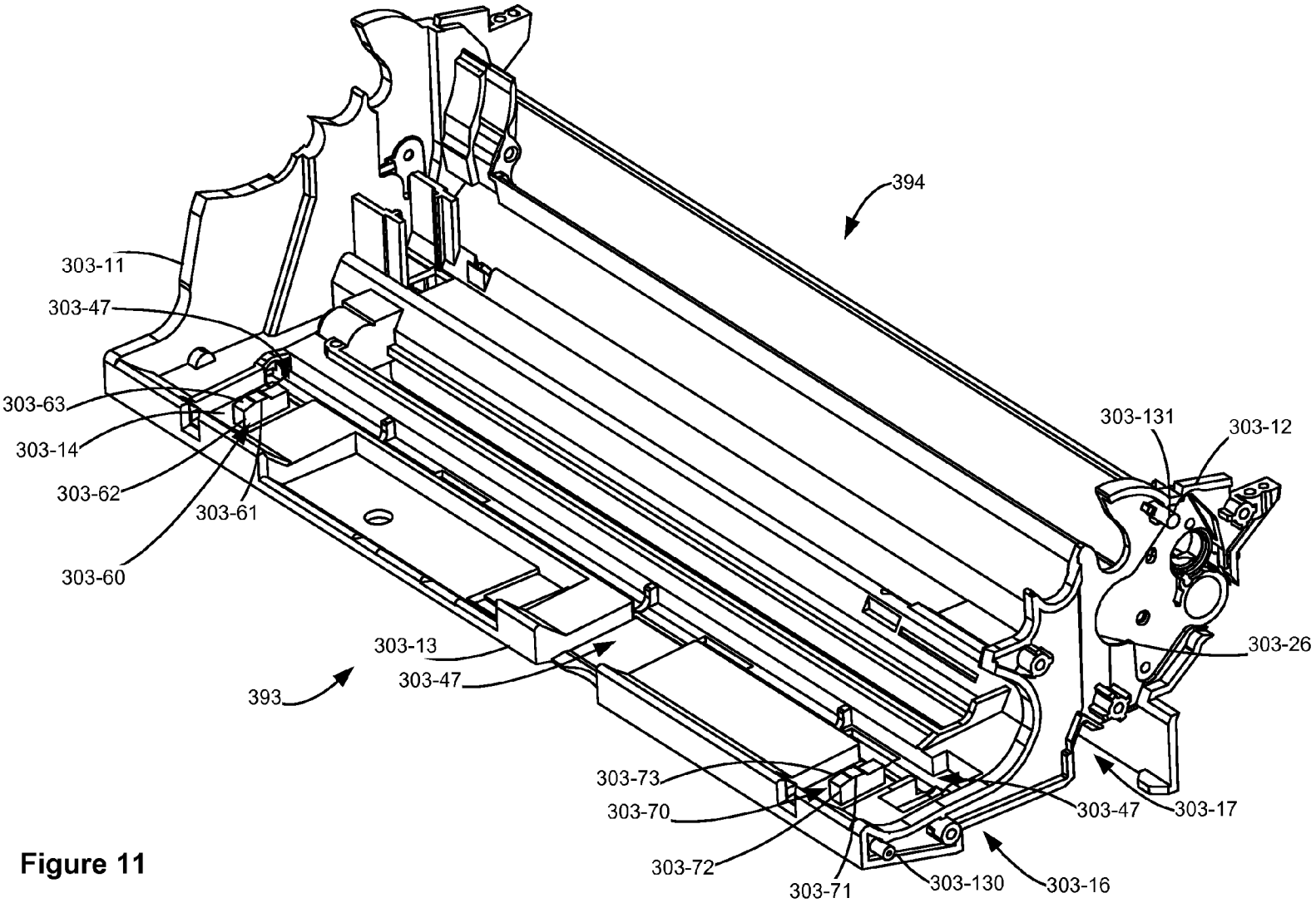
FIG. 11 is a perspective view of the frame of the replaceable unit of FIG. 8 viewed from the second end.

As illustrated in FIG. 7, a toner inlet 305-30 in communication with toner reservoir 302 is provided on the second end 305-2 of the housing 305-20 of developer unit 305. Toner inlet 305-30 is covered by a sliding shutter 147 that is biased in a dosed position by shutter spring 348. When imaging unit 300 is inserted into frame 500 an abutting member moves shutter 347 to an open position allowing toner to be fed into toner reservoir 302. Also, provided on second end 305-2 is a circuit board support member 305-40 attached by one or more fasteners 399. Support member 305-40 has a recess or pocket 305-41 in which a circuit board and connector assembly 375 is mounted. Assembly 375 includes circuit board 376 having processing circuitry 301 mounted thereon and a plurality of contacts 377 for connecting components within imaging unit 300 to an electrical power source and for connecting processing circuitry 301 with controller 102 for communication therebetween. A corresponding electrical connector is provided on frame 500 that cooperatively engages with assembly 375. Also illustrated on a side of support member 305-40 is a keying structure 305-42, shown as a flat bar, intersecting the side at an angle. The angle of keying structure 305-42 varies depending on the color or type of toner allowing keying structure 305-42 to be received in a similarly angled slot with imaging device 100 limiting insertion of an imaging unit of a certain color into only one given position in frame 500 of image forming device 100. A drive coupling 325 is provided on the second end 324 of magnetic roll shaft 322 and receives torque for rotating from a drive source in image forming device 100. First bearing 326 (see FIG. 6) and second bearing 327, whose positioning functions will be further described later, are provided adjacent the first and second ends 323, 324 of magnetic roll shaft 322. As shown, second bearing 327 is provided inboard of drive coupling 325 on second end 324 of magnetic roll shaft 322. Gear 328, mounted on first end 323 of magnetic roll shaft 322 inboard of first bearing 326, is a portion of a gear train engaged with trim bar 313 and toner augers 320 to transfer torque thereto during operation. A seal 329 is affixed to housing 305-20 along the length of magnetic roll 321 to seal between housing 305-20 and PC drum 310 when developer unit 305 is attached to PC unit 303.

Separation and attachment of the developer unit 305 with respect to the PC unit 303 outside of image forming device 100 enables the user to replace the individual unit that has reached its end of life. The separation and attachment of the developer unit 305 with respect to PC unit 303 uses three separate devices. The first two devices ensure that the customer can, among other uses, easily separate and attach the two replaceable units while the third device helps to, among other uses, limit over-rotation of the developer unit 305 and premature release of the developer unit 305 from the imaging unit 300. These functions are provided by a combination of two over-center, spring biased latches 370, 372 to provide a biasing force to the shaft 322 of magnetic roll 321, a latch bar 380, and the use of two spaced apart support members 303-60, 303-70 provided on a top surface 303-14 of bottom plate 303-13. Latches 370, 372 bias developer unit 305 against locating features in PC unit 303 when in the down position. The over-center design of latches 370, 372, ensures that the magnetic roll 321 is secured in position during operation in the image forming device 100 and also stay open when the customer flips them upward. Latches 370, 372 are pivotally mounted on first and second end walls 303-3, 303-4, respectively and are biased by springs 371, 373 respectively connected to latches 370, 372 at one end and to respective first and second end walls 303-3, 303-4 at the other (see FIGS. 19-20). Latches 370, 372 in the closed position apply a biasing force against first and second bearings 326, 327 on shaft 322 of magnetic roll 321, and together with latch bar 380 retain the attachment of developer unit 305 to PC unit 303 when the user is handling the entire imaging unit 300 to ensure the two units do not drop part during handling. With first and second latches 370, 372 open, depressing latch bar 380 rotates it downwardly toward bottom plate 303-13 releasing latch bar 380 from engagement with support members 303-60, 303-70. With latch bar 380 depressed, detachable developer unit 305 lifts out easily and allows for its replacement at its end of life.

Referring to FIGS. 8-16, first and second support members 303-60, 303-70 are provided on the top surface 303-14 of bottom plate 303-13 inboard of first and second end plates 303-11, 303-12 that depend substantially perpendicular from bottom plate 303-13. As shown, first and second support members 303-60, 303-70 project upwardly from bottom plate 303-13. During attachment of developer unit 305 to PC unit 303 both of these support members inhibit over-rotation of developer unit 305 while, after attachment has occurred, one of these two supports is used to provide a datum surface for developer unit 305 (see second support member 303-70 in FIG. 15). First support member 303-60 has a top planar surface 303-61 and a back wall 303-62 having a height less than that of top planar surface 303-61. A planar ramping surface 303-63 interconnects the top 303-64 of back wall 303-62 with top planar surface 303-61. Second support member 303-70, constructed substantially the same as first support member 303-60 has a top planar surface 303-71, a back wall 303-72 having a height less than that of top planar surface 303-71 and a planar ramping surface 303-73 interconnecting the top 303-74 of back wall 303-72 with top planar surface 303-71. Surfaces 303-61, 303-71 of support members 303-60, 303-70, respectively, form rotational stops during insertion of developer unit 305 into PC unit 303 against which correspondingly aligned treads 305-62, 305-72 of stepped ribs 305-60, 305-70 depending from the bottom 305-21 of developer unit 305 abut when developer unit 305 is attached.

Latch bar 380 comprises a base 381 pivotally mounted in channel 303-47 provided in the top surface 303-14 of bottom plate 303-13. Biasing spring 382 is attached to base 381 and bottom plate 303-13 to provide a bias force lifting latch bar 380 upward from the top surface 303-14 of bottom plate 303-13. As shown biasing spring 382 is mounted adjacent second end wall 303-4. Channel 303-47 is shown as extending substantially between first and second end plates 303-11, 303-12. Attached to base 381 are first and second catches 383, 384 having respective openings 387, 388 therethrough and release arm 385. Catches 383, 384, and release arm 385 depend substantially perpendicular to base 381. Support members 303-60, 303-70 extend through openings 387, 388 in respective first and second catches 383, 384. Release arm 385 is positioned intermediate first and second catches 383, 384, and, as shown, have a thumb rest 386 at the distal end. If latch bar 380 is not depressed, first and second catches 383, 384 are provided with lips 389, 390, respectively, which may retain developer unit 305 in imaging unit 300 independent of whether or not first and second latches 370, 372 are in the open or closed position.

Figure 12:
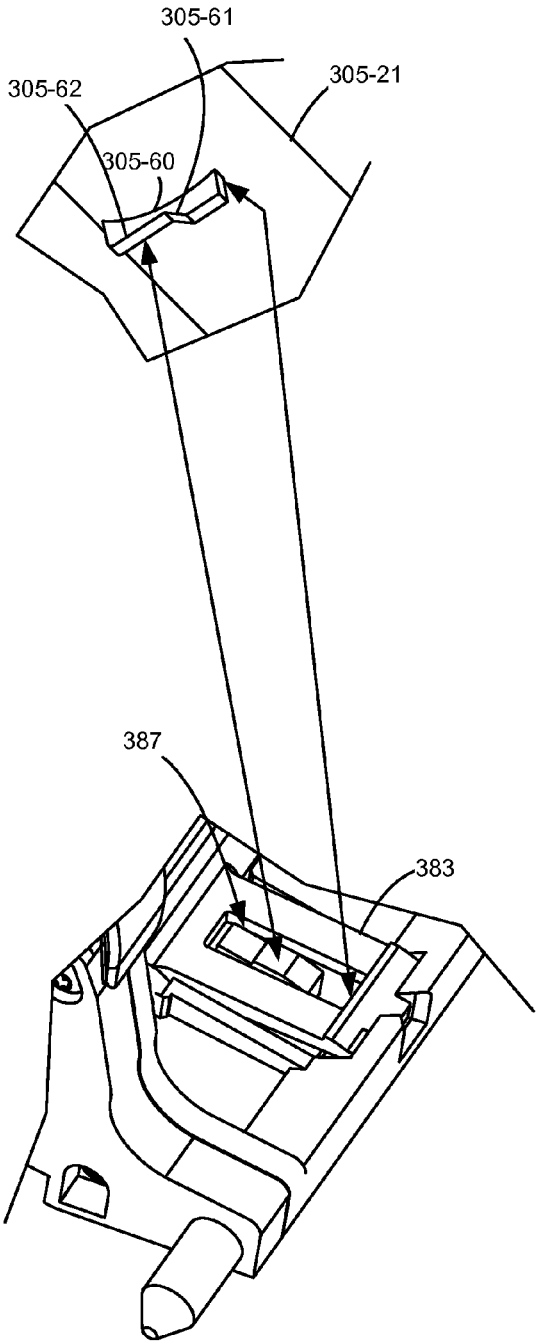
FIGS. 12-13 illustrate alignment features adjacent the first and second ends of the photoconductor unit frame with corresponding alignment features adjacent the first and second ends of the developer unit.
Figure 13:
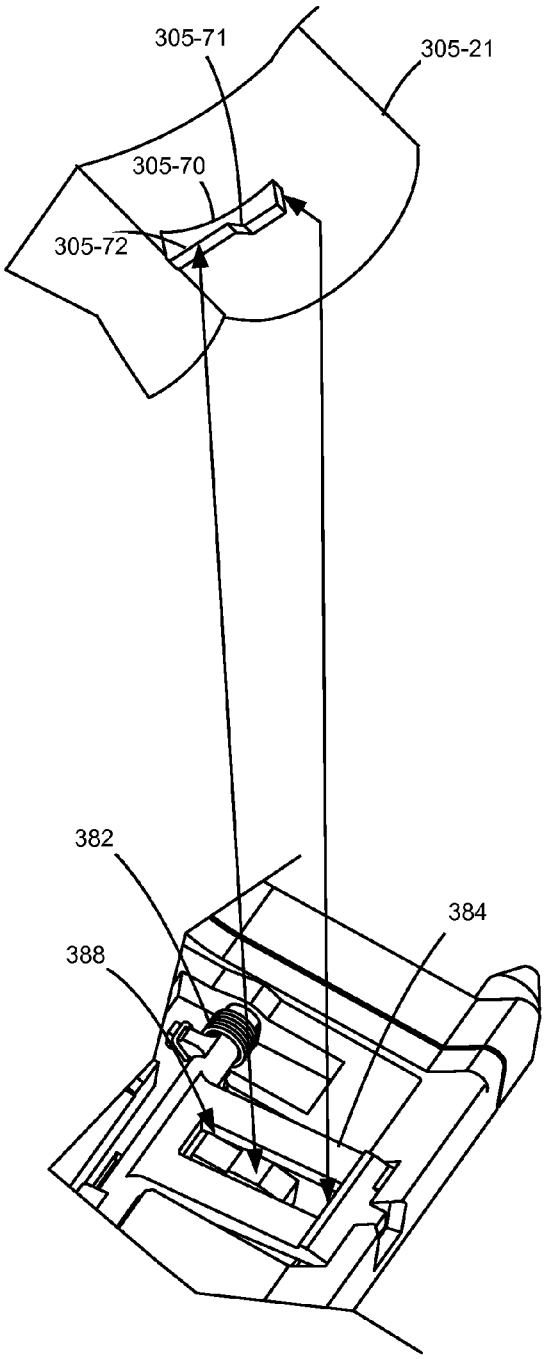

As shown in FIGS. 12-13, first and second stepped ribs 305-60, 305-70 are positioned on the bottom 305-21 of developer unit 305. Stepped rib 305-60 has a tread 305-62 and riser 305-61 and stepped rib 305-70 has a tread 305-72 and riser 305-71. During attachment of developer unit 305, stepped ribs 305-60, 305-70 will be received in openings 387, 388 in catches 383, 384, respectively. A portion of back walls 303-62, 303-72 of support members 303-60, 303-70, respectively, form rotational stops which abut against lips 389, 390, of first and second catches 383, 384 when developer unit 305 is attached to PC unit 303 and a user pulls on handle 345 of developer unit 305. When developer unit 305 is seated in PC unit 303, first and second catches 383, 384 of latch bar 380 automatically engage with stepped ribs 305-60, 305-70 due to the biasing force provided by biasing spring 382 and help to keep developer unit 305 and PC unit 303 attached together. For removal of developer unit 305, latch bar 380 is depressed allowing catches 383, 384 to disengage with first or second stepped ribs) 305-60, 305-70.

Figure 14:
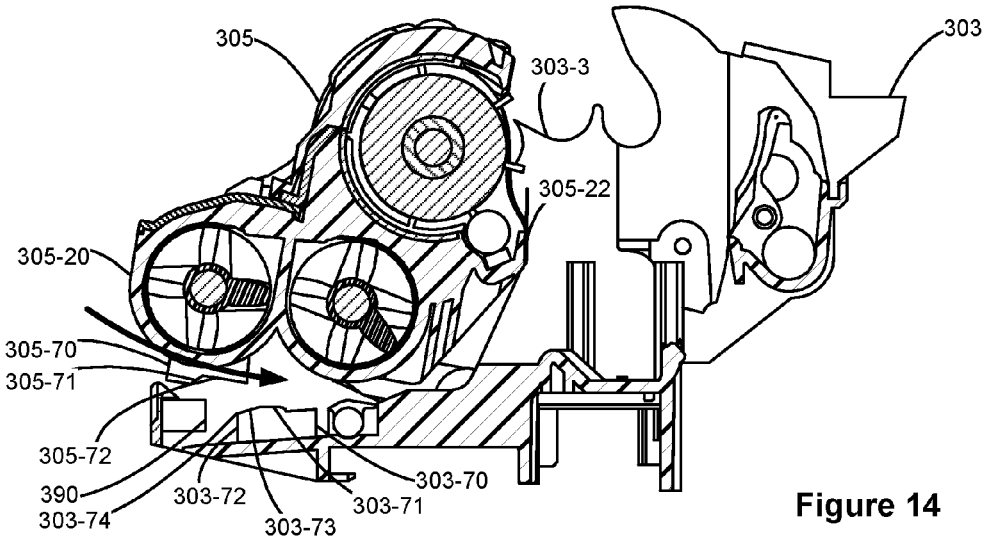
FIGS. 14-16 illustrate the insertion of the developer unit into the photo conductor unit with FIG. 16 showing the installed position of the developer unit at their respective second ends.
Figure 15:
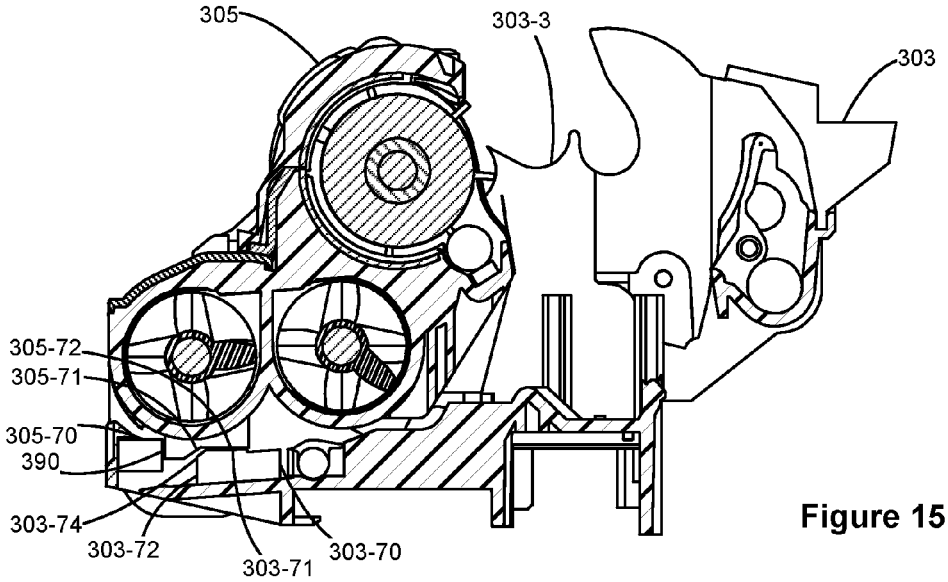
Figure 16:
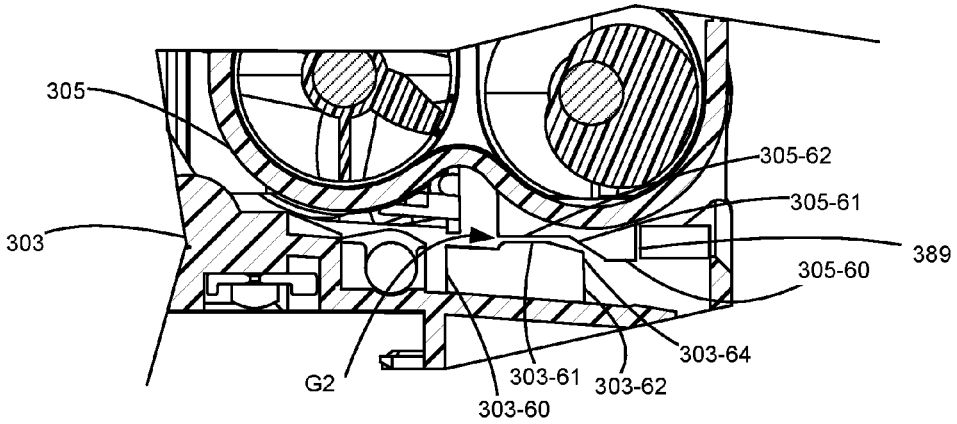
Figure 17:
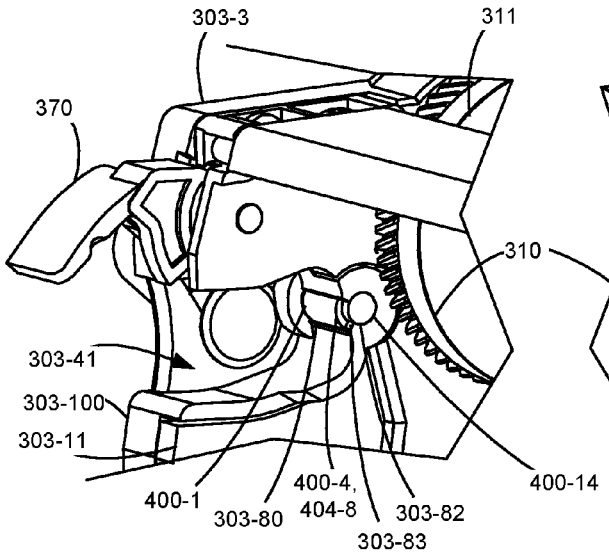
FIGS. 17-18 illustrate the latching mechanisms of the photoconductor unit in an open position.

Referring now to FIGS. 14-16, attachment of developer unit 305 to PC unit 303 is shown. Beginning in FIG. 14 developer unit 305 is being inserted into PC unit 303. A front portion 305-22 of housing 305-20 is inserted between end walls 303-3, 303-4, only end wall 303-3 is visible. As shown developer unit 305 rotates down as indicated by the arrow, first and second stepped ribs 305-60, 305-70 approach first and second support members 303-60, 303-70, only second support member 303-70 and second stepped rib 305-70 are visible. In FIGS. 15-16, developer unit 305 is seated into position against PC unit 303. In FIG. 15 the use of one of the two support members to provide a datum surface for locating developer unit 305 on PC unit 303 is shown. The top planar surface 303-71 of second support member 303-70 provides a datum surface 303-711 against which tread 305-72 of second stepped rib 305-70 seats. Top planar surface 303-71 also provides a rotational stop. FIG. 16 illustrates the positioning between first support member 303-60 and first stepped rib 305-60. A gap G2 is present between these two elements to accommodate part tolerances.

Figure 18:
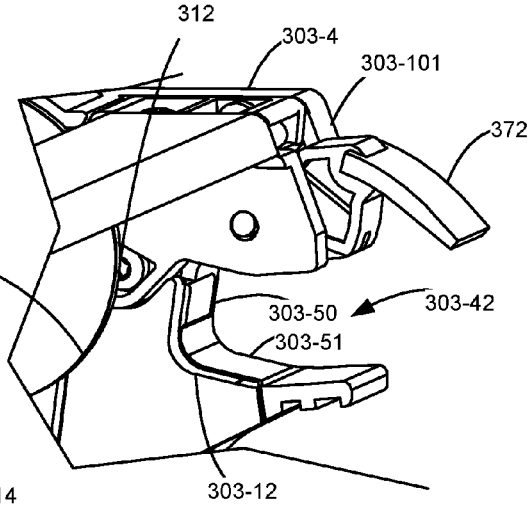
Figure 19:
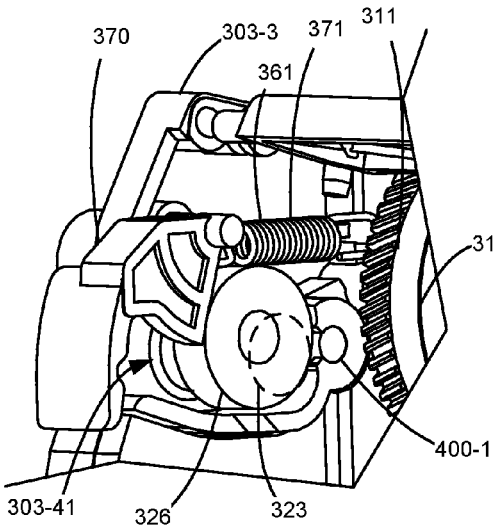
FIGS. 19-20 illustrate partially disassembled latching mechanisms of the photoconductor unit in a closed position.
Figure 20:
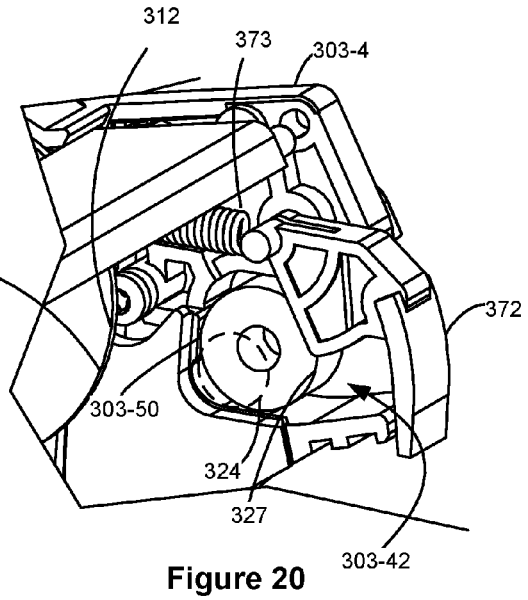
Figure 23:
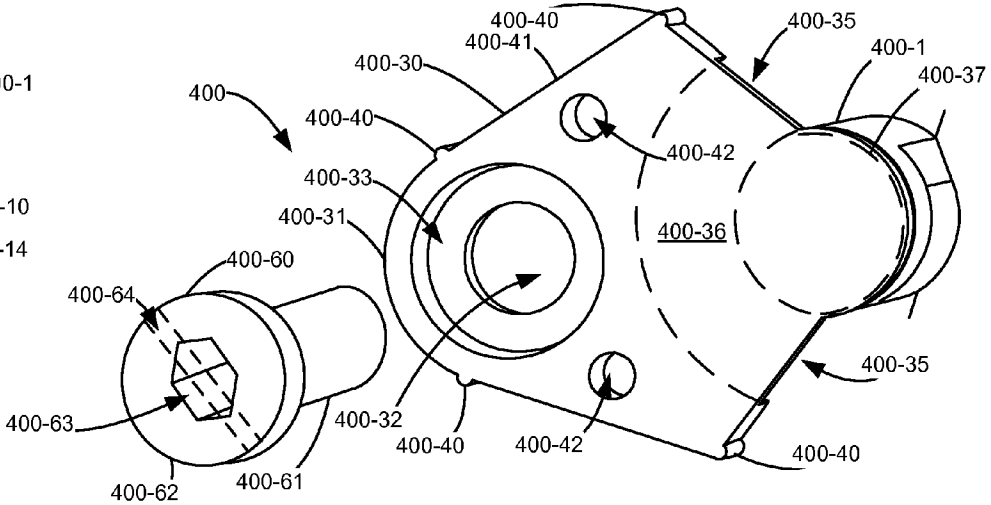
FIG. 23 illustrates a cap assembly for the deskewing plug of FIGS. 21-22.
Figure 24:
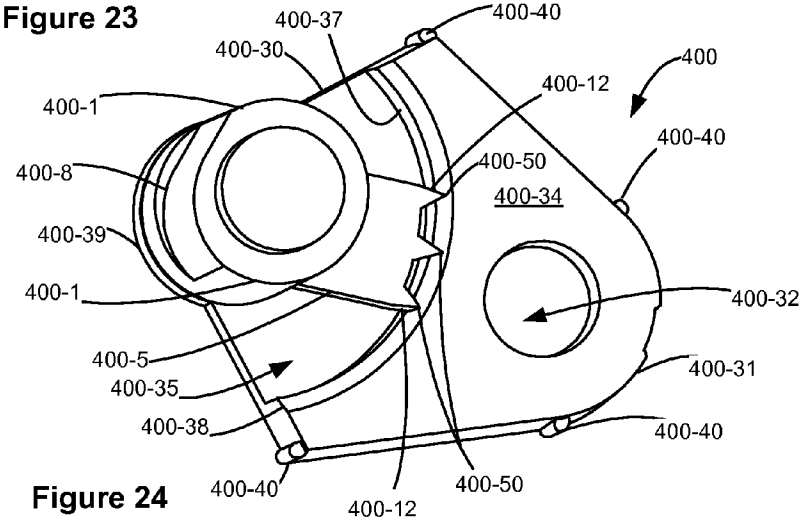
FIG. 24 illustrates the engagement of the deskewing plug of FIG. 21 with the cap of FIG. 23.
Figure 21:
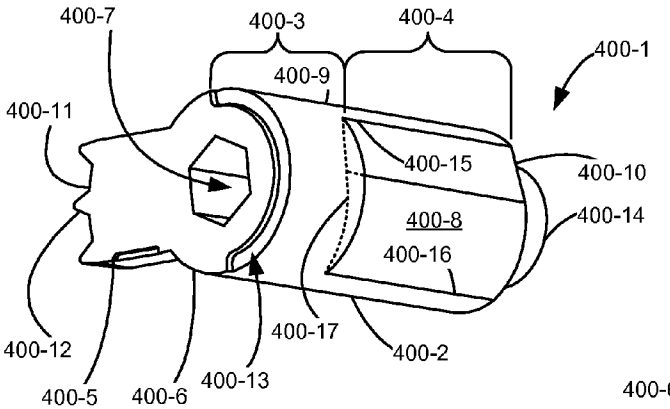
FIGS. 21-22 illustrate a deskewing plug used in the photoconductor unit.
Figure 22:
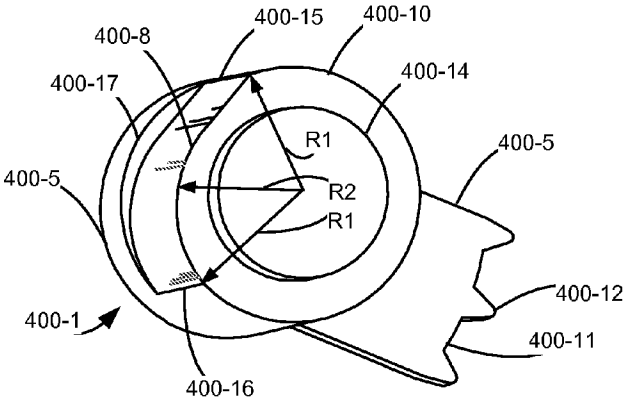
Figure 26:
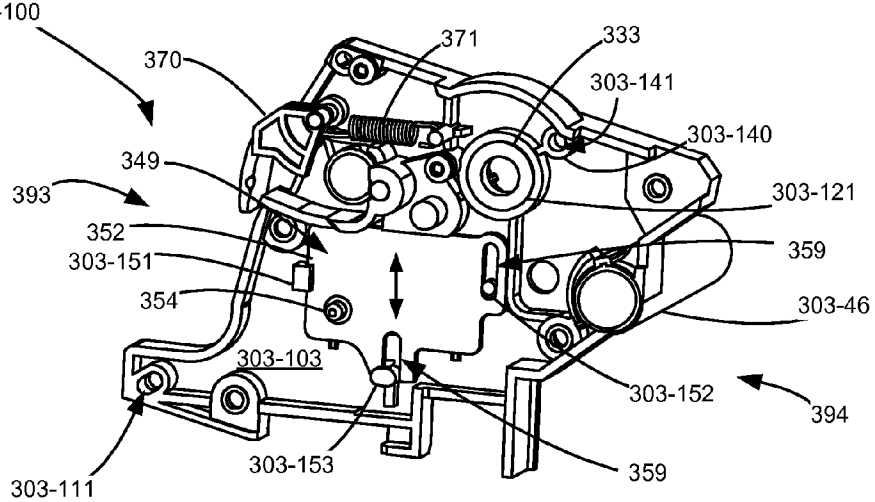
FIGS. 25-26 are perspective views of the respective front and rear sides of a first end cap attachable to the first end of the photoconductor unit.

The presence of the datum surface 303-71 alone is not sufficient to ensure positional alignment between the magnetic roll 321 and PC drum 310. PC unit 303 contains two locating features that control the gap between the magnetic roll 321 and PC drum 310 and provide additional datums as shown in FIGS. 17-20. First and second channels 303-41, 303-42 in first and second end walls 303-3, 303-4 each provide at least one locating feature. As shown first and second channel 303-41, 303-51 extend approximately parallel or at a slight angle to bottom plate 303-13. Provided in the bottom and at the closed end of second channel 303-42 is at least one datum surface. As shown in FIG. 18, datum surface 303-50 provided at the closed end of channel 303-42 is in a substantially vertical orientation to control horizontal placement of developer unit 305 while datum surface 303-51 is provided along the bottom of second channel 303-42 in a substantially horizontal orientation to control vertical position of the developer unit 305. Second bearing 327 on the second end 324 of magnetic roll shaft 322 is biased against both datum surfaces 303-50, 303-51 when second latch 372 is in the down position as shown in FIG. 20 establishing the distance for axial gap G1, also termed a reference distance (see FIG. 5) between PC drum 310 and magnetic roll 321. Provided in first end wall 303-3 at the closed end of first channel 303-41 is a deskewing plug 400-1 having a cylindrical body having an axial camming surface. Deskewing plug 400-1 is a component of a later described deskewing plug assembly 400. During attachment of developer unit 305 to PC unit 303, first bearing 326 on shaft 322 of magnetic roll 321 slides into first channel 303-41. When first latch 370 is snapped down, first bearing 326 is biased against the camming surface of the deskewing plug 400-1. With first bearing 326 biased against this camming surface, axial rotation of deskewing plug 400-1 is used to adjust the gap between the respective first ends 311, 323 of PC drum 310 and magnetic roll 321 to be substantially equal to the axial gap G1 established between respective second ends 3112, 324 of PC drum 310 and magnetic roll 321. This minimizes skew between PC drum 310 and magnetic roll 321. If needed, this deskewing adjustment may be performed when either PC unit 303 or developer unit 305 is replaced with a new unit. With both first and second latches 370, 372 snapped down on the first and second bearings 326, 327, the magnetic roll 321 is biased into the correct location in imaging unit 300, and ensuring developer unit 305 is biased against the locating features in the PC unit 303.

The variation in axial gap G1 between a developer unit and a PC unit will result in variations in the uniformity of the printed image. The utilization of a fixed gap system leads to a significant number of tolerances that stack up and create variation in the gap from one end of the module to the other. This variation in gap creates a variation in the printed image which is undesirable for the customer due to variations in electrical fields that bridge between the PC drum and magnetic roll and that attract the toner to the surface of the PC drum. In order to reduce this variation in the gap, the tolerances could be tightened to reduce this variation but this can often be costly and cannot be easily controlled due to molding variations and the quality variation between different parts suppliers. Therefore, it was desirable to have a means to adjust one end of the module to match the other end and eliminate variations in the system and provide uniform prints to the customer. Such a deskewing plug assembly will now be described.

Illustrated in FIGS. 4, and 21-24, is an example embodiment of deskewing plug assembly 400 comprised of a deskewing plug 400-1, a cap 400-30 and an optional cap fastener 400-60. Deskewing plug assembly is shown mounted in first end wall 303-3 adjacent to first latch 370. Deskewing plug 400-1 has a body 400-2 having a first portion 400-3 axially contiguous with a second portion 400-4 with first and second portions 400-3, 400-4 being generally cylindrical. A tab portion 400-5 is mounted adjacent a free end 400-6 of first portion 400-3. An opening 400-7, such as polygonal or hexagonal opening 400-7, is provided in free end 400-6 for receiving an adjusting tool, such as an Allen wrench or screw driver or other types of drivers for axially rotating deskewing plug 400-1. Within second portion 400-4 there is a camming surface 400-8 formed in a portion of a circumferential surface 400-9 of body 400-2. Deskewing plug 400-1 is mountable in an opening 303-80 provided in first end wall (see FIG. 26) of first end cap 303-100. At least the second portion 400-4 is in communication with first channel 303-41. As shown in FIG. 19, camming surface 400-8 is cooperatively engageable with either the first end 323 (indicated by dashed line) of magnetic roll shaft 322 or with first bearing 326 on magnetic roll shaft 322. Axial rotation of the deskewing plug 400-1 and camming surface 400-8 adjusts a distance between the magnetic roll shaft 322 or first bearing 326 and first end 311 of PC drum 310 to match the reference distance or axial gap G1 set between one of second bearing 327 or second end 324 of magnetic roll shaft 322 at second channel 303-42. The first and second ends 400-15, 400-16 of camming surface 400-8 each have a radius R1 that is substantially the same as the radius of circumferential surface 400-9 of body 400-2. The radius R2 of camming surface 400-8 intermediate its first and second ends 400-15, 400-16 decreases to a predetermined minimum value at a position that is approximately midway between first and second ends 400-15, 400-16 allowing axial gap G1 to be decreased if needed. A generally crescent shaped side wall 400-17 is formed between camming surface 400-8 and circumferential surface 400-9.

Figure 25:
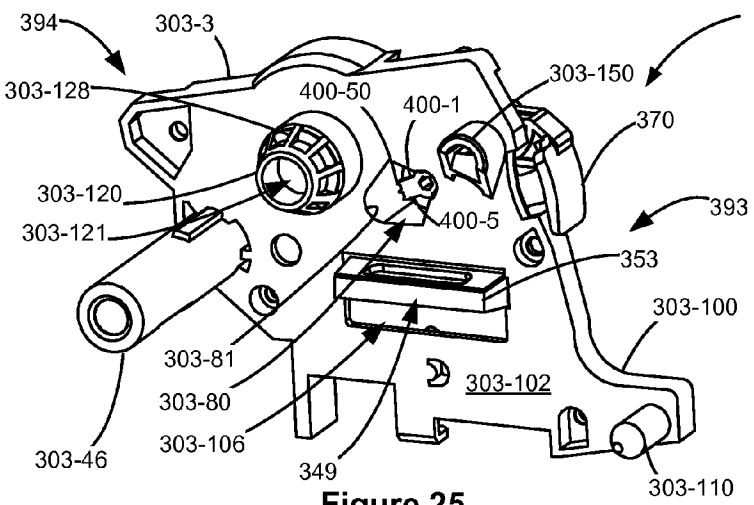
Figure 28:
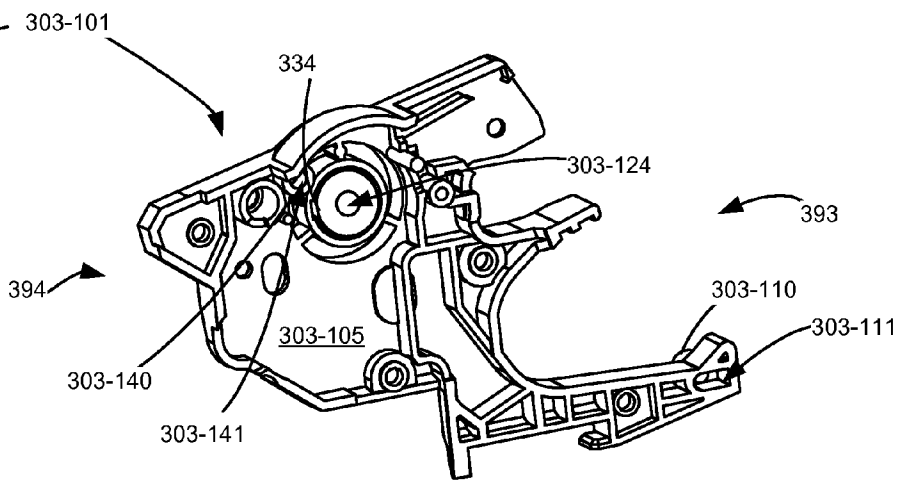
FIGS. 27-28 are perspective views of the respective front and rear sides of a second end cap attachable to the second end of the photoconductor unit.
Figure 27:
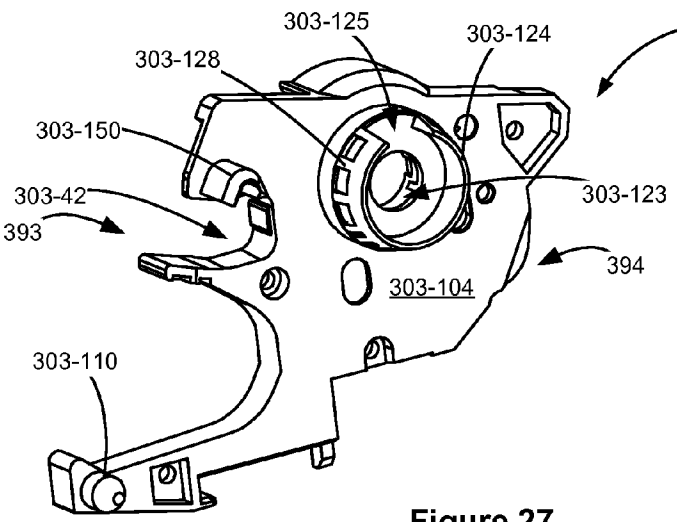
Figure 29:
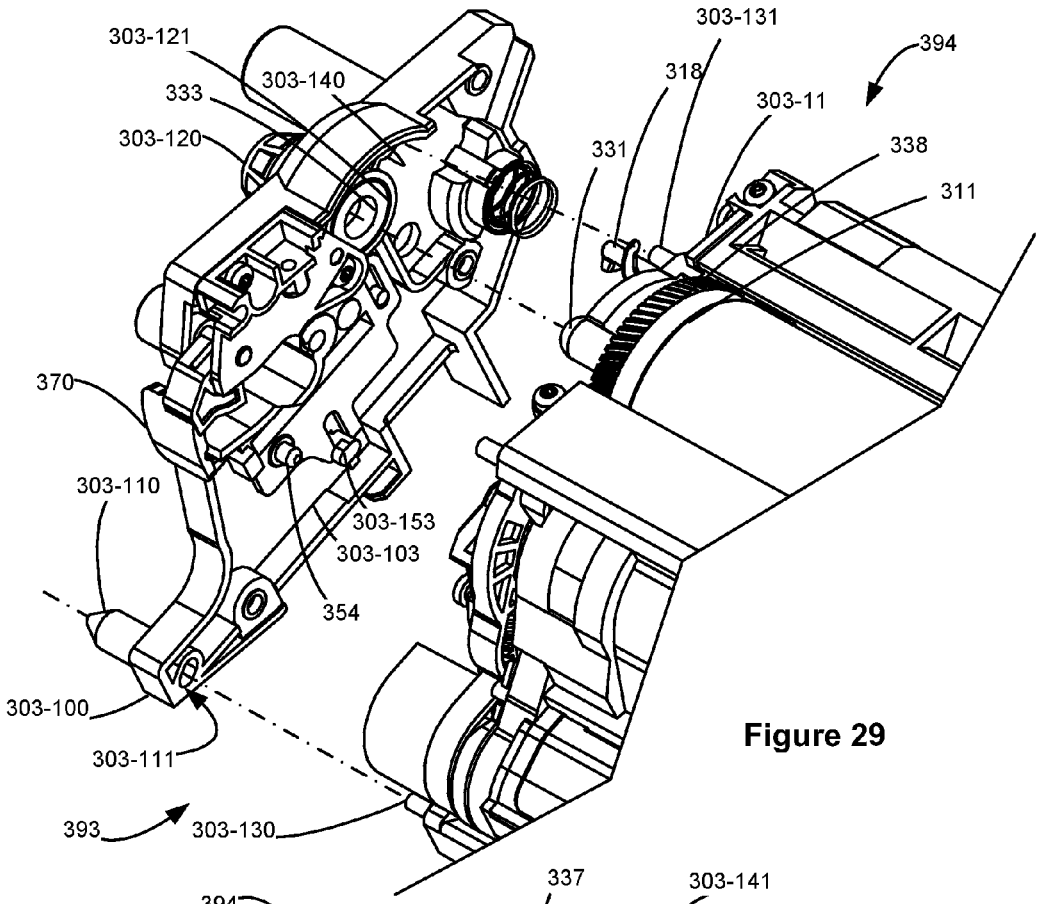
FIGS. 29-30 are perspective views illustrating the alignment features of the first and second end caps with the first and second end plates of the frame of the photoconductor unit.
Figure 30:
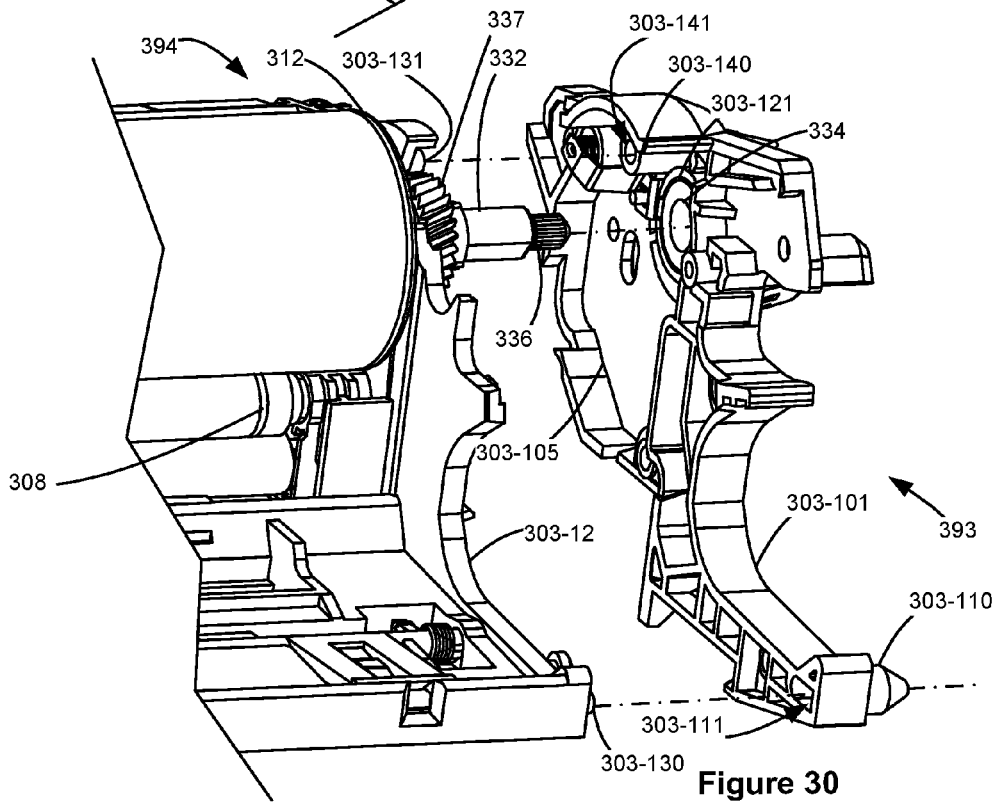

Once the gap G1 between PC drum 310 and magnetic roll 321 is set using deskewing plug 400-1, further rotational movement of deskewing plug 400-1 should be prevented. This may be accomplished through the use of tab portion 400-5 radially extending from the free end 400-6 of first portion 400-3 and having one or more radially extending ridges or teeth 400-12 at a free end 400-11 of tab portion 400-5. The one or more ridges or teeth 400-12 frictionally engage with the frame 303-10 at one or more corresponding engagement points 400-50 as shown in FIG. 25 where ridges or teeth 400-12 are shown engaged with a side wall 303-81 of opening 303-80. However, it will be realized that over time when multiple adjustments have been made to de plug 400, side wall 303-81 may become worn. Cap 400-30 may be used to avoid this.

As shown in FIGS. 4 and 23-25 cap 400-30 is used to engage with tab portion 400-5 and the free end 400-6 of first portion 400-3. An arcuate recess 400-35 is provided in the bottom surface 400-34 of cap 400-30 and is sized to accommodate the free end 400-6 of first portion 400-3 and tab portion 400-5. Again, after deskewing plug 400-1 is rotationally adjusted, cap 400-30 is inserted onto the free end 400-6 of body 400-2 and tab portion 400-5. One or more holes 400-42 may be provided on the top or outer surface 400-36 of cap 400-30 to accommodate tooling used to help insert cap 400-30 onto deskewing plug 400-1. The one or more teeth 400-12 of tab portion 400-5 engage with a side wall 400-37 of recess 400-35 at engagement points 400-50 when cap 400-30 is pressed into place in opening 303-80 and onto deskewing plug 400-1. A chamfer 400-38 may be provided along the top of side wall 400-37 to help with installation of cap 400-30. Cap 400-30 and opening 303-80 are similarly shaped so that cap 400-30 will not be free to rotate. As shown, cap 400-30 and opening 303-80 are generally fan-shaped. A lip 400-39 may be provided on cap 400-30 which is received into a corresponding cutout or recess 400-13 provided in free end 400-6 of first portion 400-3. This allows the outer edge of cap 400-30 to align with the circumferential surface of first portion 400-3. One or more ribs 400-40 may be provided about a perimeter 400-41 of cap 400-30 allowing cap 400-30 to frictionally engage with the side wall 303-81 of opening 303-80. Because the teeth 400-12 engage with cap 400-30 rather than side wall 303-81 should further adjustments of camming surface 400-8 be needed, a new cap 400-30 may be used should the old one become worn.

Opening 400-32 may be provided adjacent to a free end 400-31 of cap 400-30 to allow an optional fastener 400-60 to be inserted therethrough to further secure cap 400-30 to first end wall 303-3. As shown, fastener 400-60 has a body 400-61 having head 400-62 on one end thereof. Head 400-62 is provided with a drive opening 400-63, such as hexagonal opening 400-63 or slotted opening 400-64. An additional recess 400-33 may be provided the top surface 400-36 of cap 400-30 about opening 400-32 to accommodate fastener head 400-62 therein to provide a flush mount for fastener 400-60 on first end wall 303-3. Also, a free end 400-10 of second portion 400-4 may be provided with a reduced diameter extension 400-14 that is received in a correspondingly sized opening 303-82 provided in a bottom wall 303-83 of opening 303-80 to provide additional support for plug body 400-2 (see FIGS. 10 and 25).

Referring now to FIGS. 4-11 and 25-33, a multiplicity of alignment features on bottom plate 303-13 and first and second end caps 303-100, 303-101 used to align imaging unit 300 with frame 500 will now be described.

First end wall 303-3 is formed by first end plate 303-11 having first end cap 303-100 removably attached thereto by a plurality of fasteners 399. One or more alignment features are provided on the outer surface 303-25 of first end plate 303-11 and on the outer and inner surfaces 303-102, 303-103 of first end cap 303-100. Second end wall 303-4 is formed by second end plate 303-12 having second end cap 303-101 removably attached thereto by a plurality of fasteners 399. One or more alignment features are provided on the outer surface 303-26 of second end plate 303-12 and on the outer and inner surfaces 303-104, 303-105 of second end cap 303-101.

A first bullet nose 303-110 depends from each of outer surfaces 303-102, 303-104 in the lower front corner of first and second end caps 303-100, 303-101, respectively. First bullet nose 303-110 on outer surface 303-102 of first end cap 303-100 is also positioned below waste toner exit port 303-46 that is located adjacent to a rear edge of first end cap 303-101 First bullet nose 303-110 on outer surface 303-104 of second end cap 303-101 is also positioned below channel 303-42. First bullet noses 303-110 act as rotational stops to control the axial rotation of imaging unit 300 about the longitudinal centerline of PC drum 310 when mounted in frame 500 and positions window 303-18 to allow the laser beam 113 to impinge on the surface of PC drum 310 without impinging on frame 303-10 of PC unit 303. First bullet noses 303-110 are parallel to the axis of rotation of PC drum 310.

Provided in each of first bullet noses 303-110 is opening 303-111 accessible from the inner surfaces 303-103, 303-105 of first and second end caps 303-100, 303-101, respectively. Provided on the outer surfaces 303-25, 303-26 of first and second end plates 303-11, 303-12 are alignment pins 303-130, 303-131. Alignment pins 303-130 depend from the lower front portions of end plates 303-11, 303-12 and are aligned to be received into respective openings 303-111, illustrated as a slotted opening, when respective end caps 303-100, 303-101 are attached. Alignment pins 303-131 depend from the upper rear portions of end plates 303-11, 303-12 and are received into respective openings 303-141, shown as circular openings, in mounting bosses 303-140 provided on the inner surfaces 303-103, 303-105 of first and second end caps 303-100, 303-101, respectively. Alignment pins 303-130, 303-131 and openings 303-111, 303-141, are parallel to the axis of rotation of PC drum 310.

Centered in openings 303-121, 303-123 of second bullet noses 303-120, 303-122 respectively are bearings 333, 334 which respectively receive and rotatably support first and second shaft ends 331, 332 of PC drum 310 when first and second end caps 303-100, 303-101 are attached. Opening 303-121 in second bullet nose 303-120 shown as a blind opening while opening 303-123 in second bullet nose 303-122 is a through opening to allow the second shaft end 332 to extend through second end cap 303-101. Drive coupler 335 is mounted on second shaft end 332 within opening 303-123. Splines 336 may be provided on second shaft end 332 to receive and seat drive coupler 335 onto second shaft end 332. Drive coupler 335 is engageable with a drive source provided in image forming device 100. An axial slot or opening 303-125 may also be provided along a portion of the length of wall 303-124 of second bullet nose 303-122 allowing access to drive coupler 335 after it has been seated on second shaft end 332 to ease in its removal if needed. Ribs 303-128 may be provided on the outer circumferential surfaces of second bullet noses 303-120, 303-122 which will engage with the walls of corresponding openings provided in frame 500 when imaging unit 300 is installed. The conical shape of second bullet noses 303-120, 303-122 aid in aligning each imaging unit 300 and PC drum 310 with frame 500 to ensure that PC drum 310, when installed, will be perpendicular to intermediate transfer member 191 or to the media path if no such member is used. This alignment ensures that the toned image carried by PC drum 310 registers on either intermediate transfer member 191 or the media sheet with little or no skewing.

First bullet noses 303-110, alignment pins 303-130, 303-131 are parallel to the axis of rotation of PC drum 310. The centerlines of second bullet noses 303-120, 303-122 and the center of bearings 333, 334 are coaxial with the axis of rotation of PC drum 310. The engagement between mounting bosses 303-140 and alignment pins 303-131 and first and second shaft end 331, 332 with second bullet noses 303-120, 303-122 ensure axial alignment of PC drum 310 when first and second end caps 303-100, 303-101 are mounted to first and second end plates 303-11, 303-12. Also provided on the upper front portions of outer surfaces 303-102 and 303-104 of first and second end caps 303-100, 303-101 is a pair of axially aligned stop arms 303-150 whose function in conjunction with first bullet noses 303-110 and second bullets noses 303-120, 303-122 will be later described.

Figure 31:
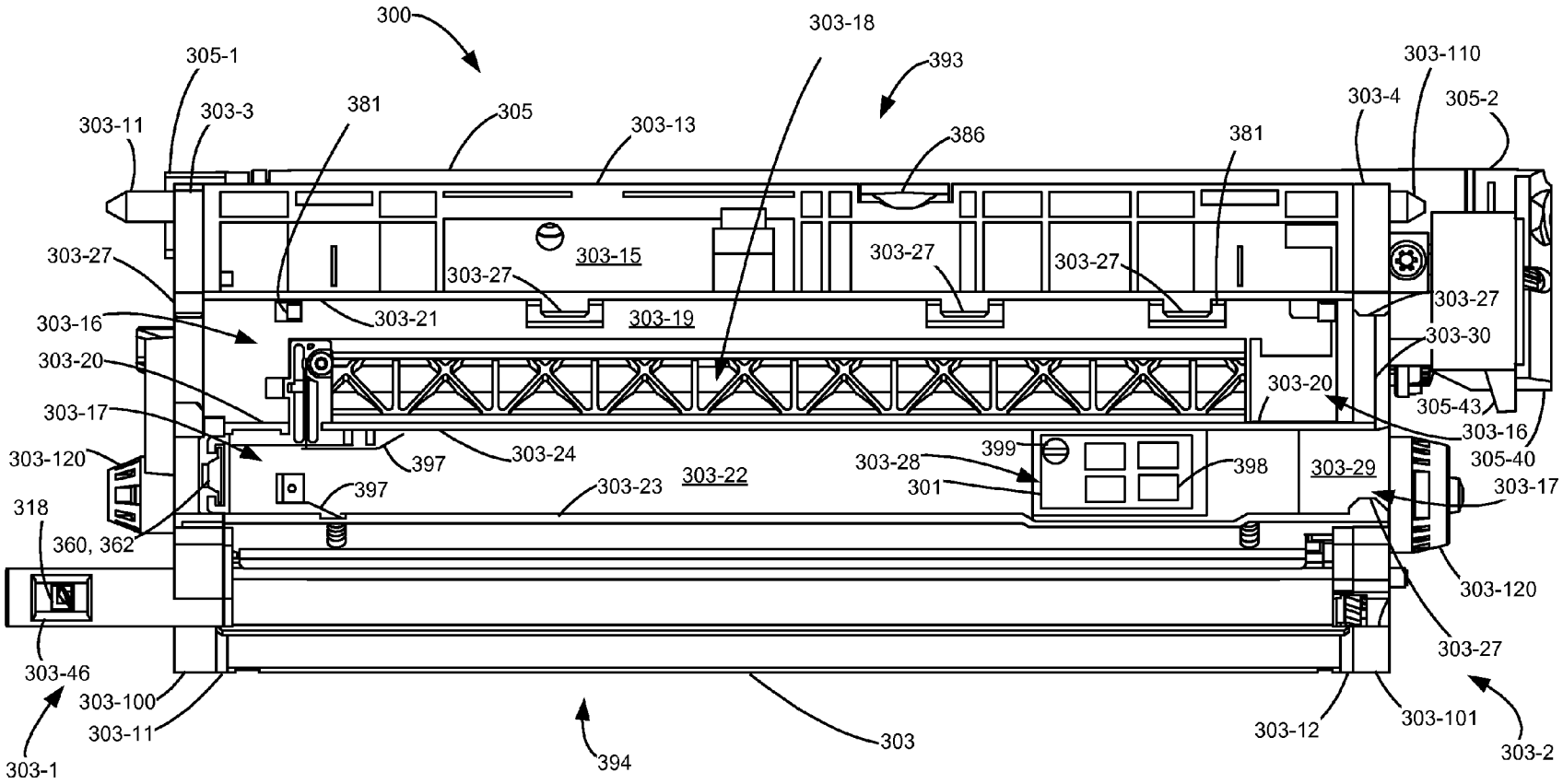
FIG. 31 is a view of the alignment features on the bottom of an imaging unit.
Figure 32:
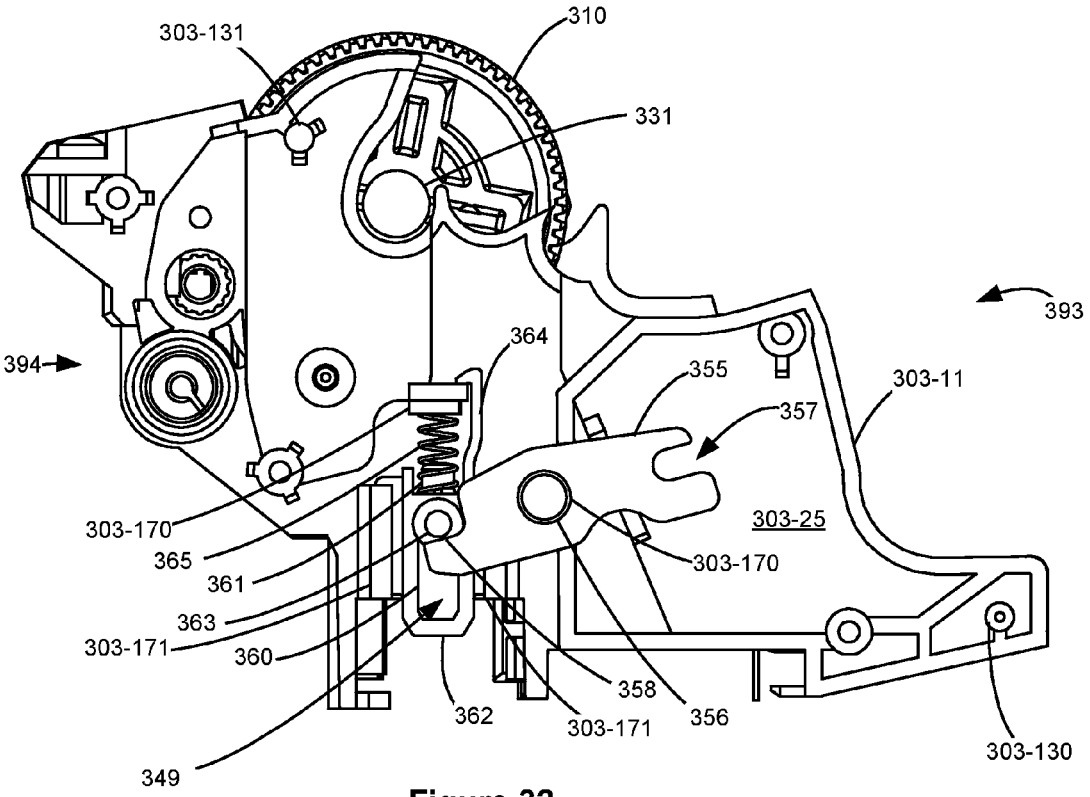
FIG. 32 is a view of the first end of the photoconductor unit with the end cap removed.

Referring now to FIG. 31 various mounting and alignment features provided in the bottom of imaging unit 300 will be described. Developer unit 305 is mounted to PC unit 303 forming imaging unit 300. First and second channels 303-16, 303-17 in bottom plate 303-13 extend between first and second ends 303-1, 303-2 of PC unit 303. First channel 303-116 has a first wall 303-20, a second wall 303-21 and roof 303-19. Window or slot 303-18 is provided in roof 303-19 as previously described. Chamfer 303-30 may be provided on roof 303-19 at second end 303-2 to ease insertion of imaging unit 300. Second channel 303-17 has a first wall 303-23, a second wall 303-24 and roof 303-22. A recess 303-2.8 is provided in roof 303-22. Processing circuitry 301 is mountable within recess 303-28 with electrical contacts 398 facing away from roof 303-22. An upwardly directed ramp or camming surface 303-29 is provided in roof 303-72 adjacent second end 303-2 to lift imaging unit 300 during installation into frame 500. Contacts 397 are also provided in second channel 303-17 along first and second walls 303-23, 303-24 adjacent first end 303-1 for receiving electrical potential from imaging forming device 100 for charging components within PC unit 303 and developer unit 305. Latch arm 360 and insertion end 362 of handle assembly 349 can be seen adjacent mounted adjacent to second channel 303-17 at first end 303-1. Inwardly extending lips 303-27 may be provided along the distal ends of walls 303-21 and 303-23 which aid in guiding imaging unit 300 into position in frame 500. Waste toner auger 318 and waste toner exit port 303-46 is also visible near first end 303-1 of imaging unit 300.

Referring now to FIGS. 25-26 and 32-33, features of handle assembly 349 will be described. Components of handle assembly 349 are mounted on the inner surface 303-103 of first end cap 303-100 and on the outer surface 303-25 of first end plate 303-11. Handle 351 is slidably mounted to first end cap 303-100. Handle base 352 is positioned on inner surface 303-103 of first end cap 303-100. Grasping portion 353 attached to handle base 352 projects through opening 303-106 in end cap 303-1100. Opening 303-106 is sized to allow grasping portion 353 to move up and down therein as indicated by the double-ended arrow in FIG. 26. Guides 303-151-303-153 depend from inner surface 303-103. The distal end of guide 303-151 has a lip which slidably retains handle base 352 against inner surface 303-103. Guides 303-152, 303-153 are shown in the form of pins, and are received in corresponding vertical slots 359 provided in handle base 352. Guide 303-153 may also be provided with a lip at its distal end for engaging handle base 352 (see FIG. 29). Depending from the outer surface of handle base 352 is engagement pin 354 having a function to be later described.

Provided opposite to base 352 on first end plate 303-11 are lift arm 355, latch arm 360, and bias spring 365. Lift arm 355 is pivotally mounted via pivot hole 356 to pivot pin 303-170 depending from outer surface 303-25. Provided on opposed ends of lift arm 355 are engagement pin slot 357 and latch arm lift pin slot 358. Latch arm 360 is slidably positioned between opposed guides 303-171 that also depend from outer surface 303-25. The lower end of latch arm 360 forms insertion end 362 which will engage with a corresponding slot provided in frame 500 when imaging unit 300 is installed therein. A spring mount 361 is provided on the upper end of latch arm 360 along with a vertically extending catch arm 364. Aligned with but spaced above spring mount 361 is spring seat 303-180 depending from outer surface 303-25. Bias spring 365 is inserted between spring mount 361 and spring seat 303-180. Catch arm 364 engages with spring seat 303-180 to limit the downward vertical travel of latch arm 360. Latch arm lift pin 363 engages with latch arm lift pin slot 358 provided in lift arm 355.

With first end cap 303-100 fastened to first end plate 303-11, engagement pin 354 is received into engagement pin slot 357 of lift arm 355 and grasping portion 353 will be positioned at the top of opening 303-106. Sliding grasping portion 353 downwardly will pivot lift arm 355 which engages with latch arm lift pin 363 to lift latch arm 360 vertically upward. This would allow a user to remove an installed imaging unit 300 from frame 500. Insertion end 362 is chamfered on its back surface (see FIG. 33). During insertion of imaging unit 300 into frame 500, the chamfering allows latch arm 360 to move vertically and then due to the biasing force provided by bias spring 365 automatically snap down into a corresponding slot provided in frame 500 preventing over-insertion of imaging unit 300 into frame 500 as well as helping to retain imaging unit 300 in frame 500 against forces applied to imaging unit 300 when the drive source is coupled to drive coupler 335 on PC drum shaft 330 and to drive coupler 325 on magnetic roll shaft 322.

Figure 33:
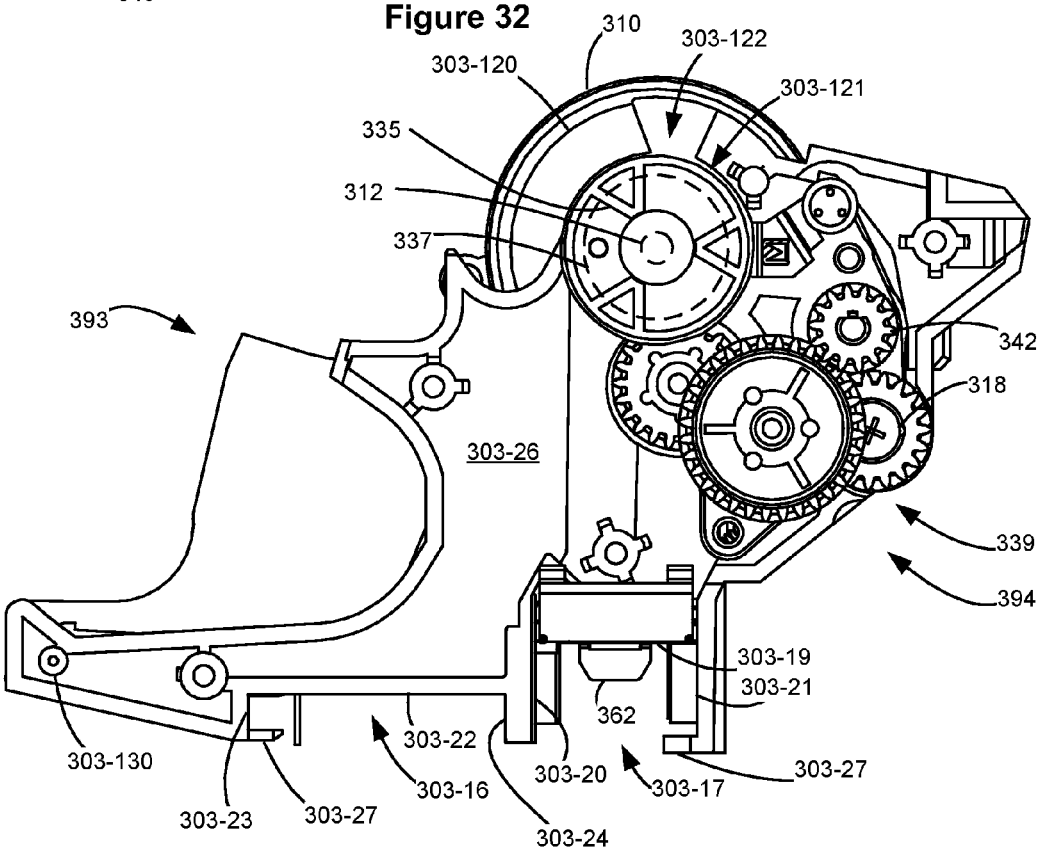
FIG. 33 is a view of the second end of the photoconductor unit with the end cap removed.

Referring now to FIG. 33, drive train 339 is shown. Drive train 339 is composed of a plurality of gears which couple waste toner auger 318, and brush 342 to PC drum drive gear 337 provided on PC drum second end 312 (See FIG. 30). Charge roll 308 is driven by PC drum drive gear 338 provided on PC drum first end 311 (See FIG. 31). Torque received by drive coupler 335 rotates PC drum drive gear 337 which in turn provides torque to drive train 339.

Frame 500 and components thereof along with the installation of imaging units 300 in frame 500 are illustrated in FIGS. 34-45. Frame 500 is comprised of a front panel 500-1, a rear panel 500-2, a side panel 500-3 and a bottom panel 500-4 connected to both the front and rear panels 500-1, 500-2 forming a U-shaped structure. Panels 500-1, 500-2, 500-3 may be made of stamped metal or a rigid plastic. Fixed between the front and rear panels 500-1, 500-2 are four rail assemblies 600 on which imaging units 300 will be mounted. It should be realized that for a single color image forming device only a single rail assembly 600 would be used. The four rail assemblies 600 are arranged in a staircase fashion with the lowest assembly being illustrated as positioned on the left. The rail assemblies 600 and front, rear, side and bottom panels 500-1-500-4 form a wedge-shaped space 500-5 through which the laser beams 113 pass. The top edges 500-7, 500-8 of front and rear panels 500-1, 500-2 are shaped to provide support for four toner cartridges.

Front panel 500-1 has a large central opening 500-10 to allow for the installation of the four rail assemblies 600 and imaging units 300. Attached to front panel 500-1 is door assembly 700 comprised of a door plate 701, a cover 702, a pair of hinges 703 and a pair of latches 704. A plurality of bell crank assemblies 800 are mounted in an outer surface of door plate 701 and would be covered by cover 702 when attached to door plate 701. Hinges 703 are placed at the bottom of door plate 701 and are affixed to front panel 500-1. Door assembly 700 substantially covers central opening 500-10 in its raised or closed position (see FIG. 37). With door assembly 700 lowered, access is provided for installing and removing imaging units 300.

Figure 34:
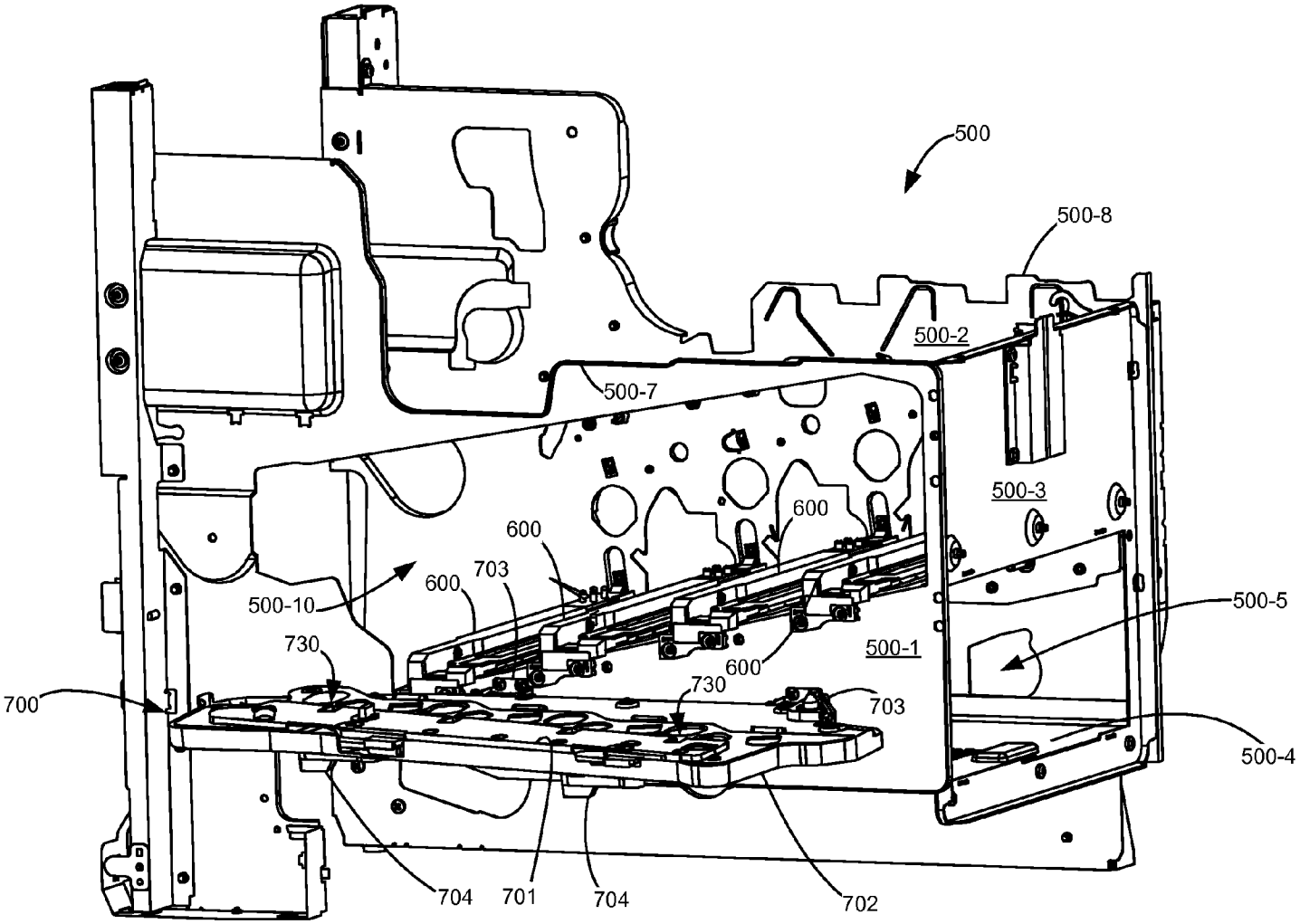
FIG. 34 is a perspective view of a frame for holding multiple imaging units as viewed from the front.
Figure 35:
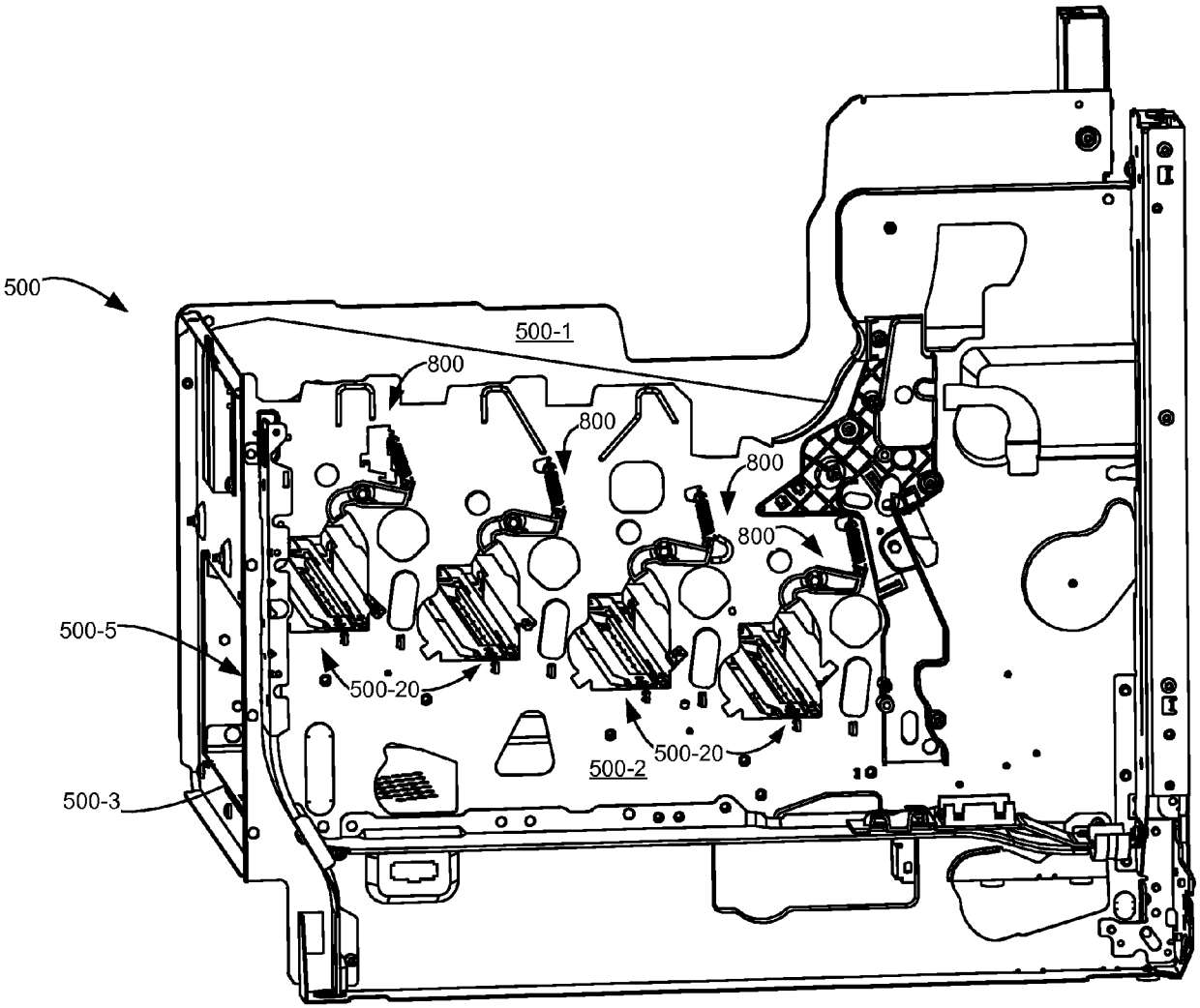
FIG. 35 is a perspective view of the rear of the frame of FIG. 34.
Figure 36:
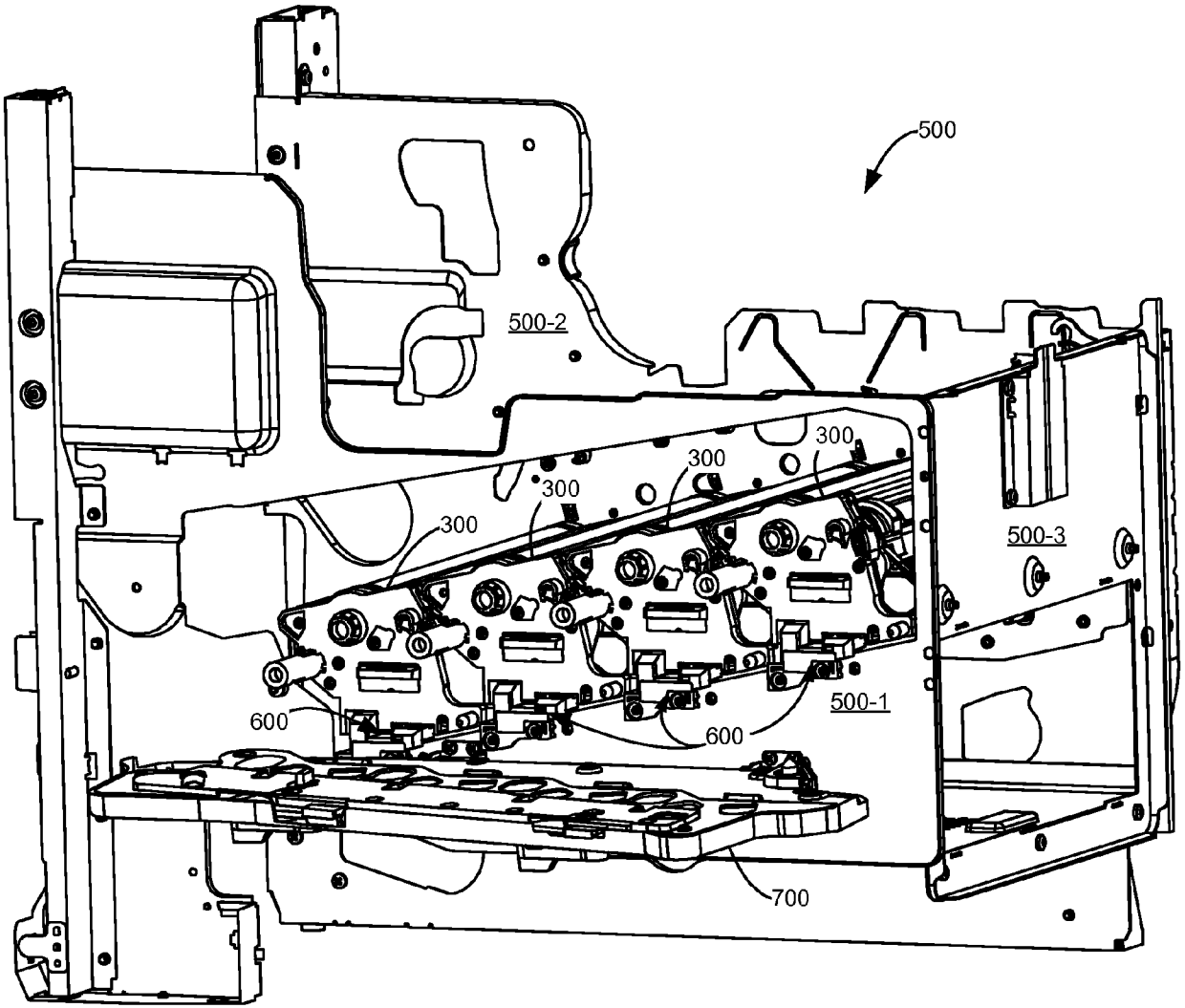
FIG. 36 is a perspective view of the frame of FIG. 35 having multiple imaging units installed and a door in an open position.
Figure 37:
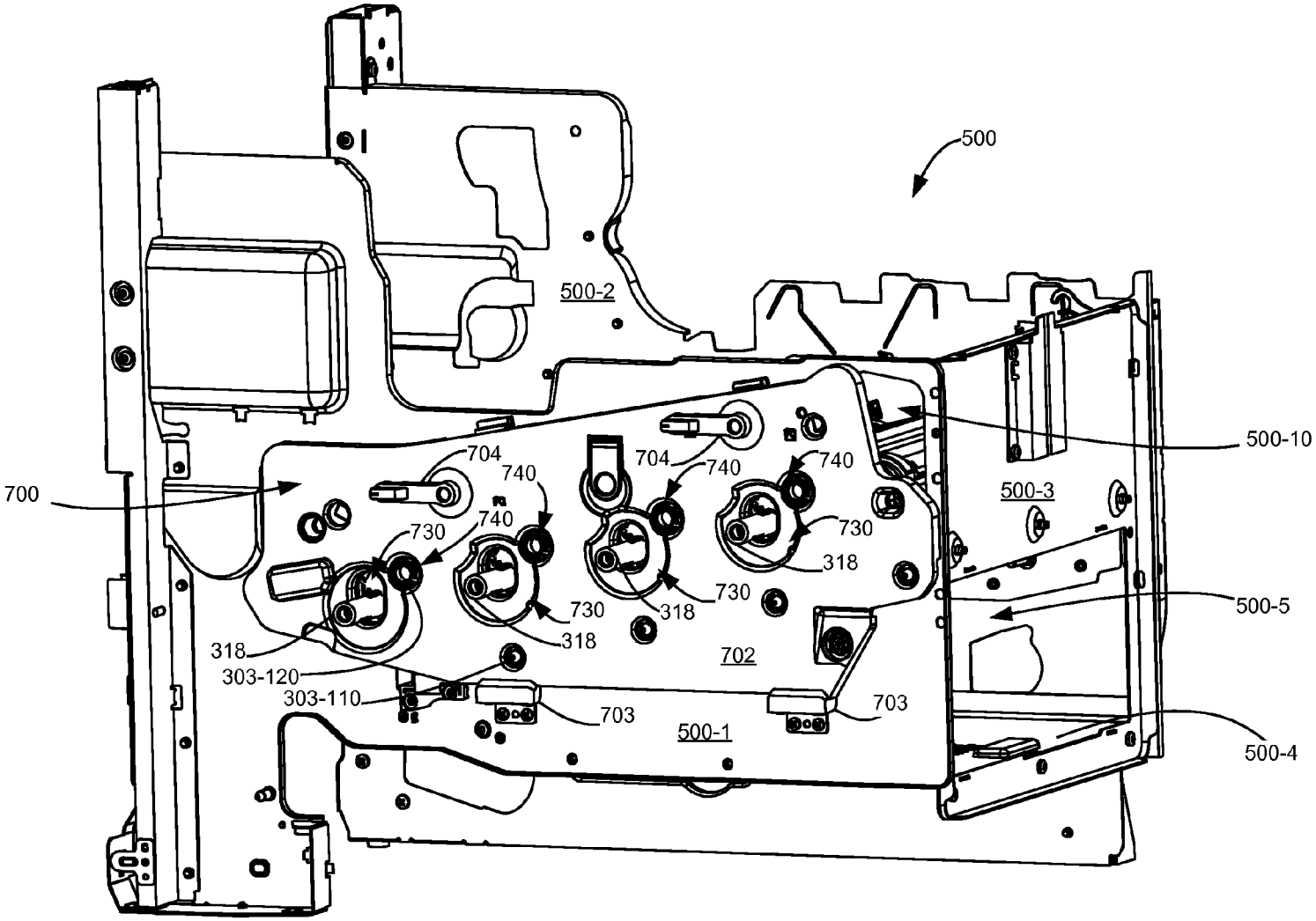
FIG. 37 is a perspective view of the frame of FIG. 35 having a door shown in a closed position.

As shown in FIGS. 34-35, frame 500 is empty and ready to receive imaging units 300. Door assembly 700 is in an open position. Imaging units 300, comprised of PC unit 303 and developer unit 305, are passed through central opening 500-10 and slidably engage with rail assemblies 600 using alignment features provided on the bottom plate 303-13 and on first end cap 303-100 of PC unit 303. In FIG. 36, four imaging units 300 have been installed on their corresponding rail assemblies 600 with door assembly 700 shown in the open position. From the left, the four imaging units may have black toner, magenta toner, cyan toner and yellow toner. In FIG. 37, door assembly 700 has been moved to the closed position with latches 704 engaging with the upper edge of central opening 500-10 or other suitable catches provided on front panel 500-1. Imaging units 300 have aligned themselves with their corresponding rail assembly 600 and alignment features discussed below provided in door plate 701 and rear panel 500-2.

Figure 38:
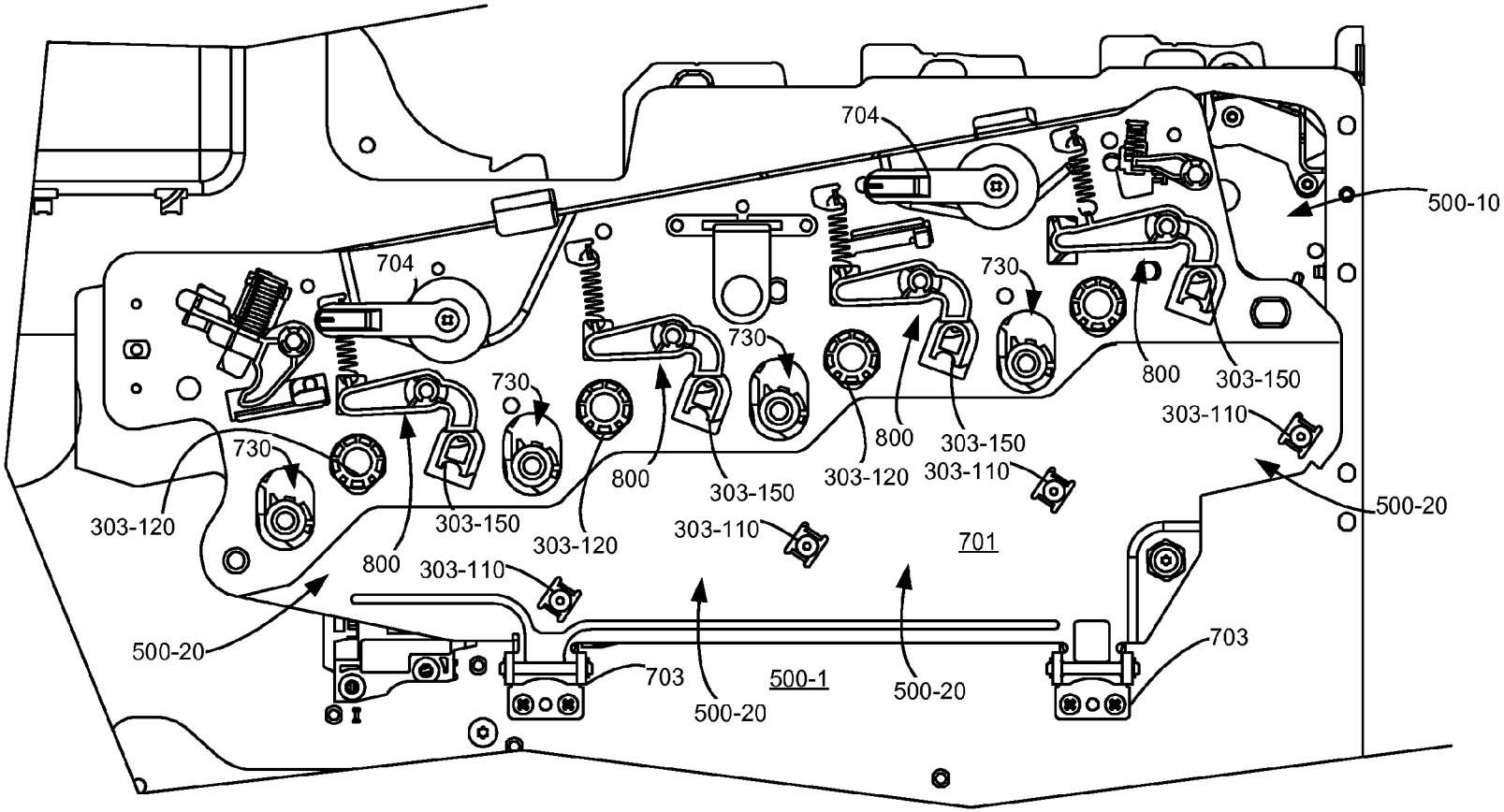
FIG. 38 is a partial front view of the frame of FIG. 36 illustrating the engagement of alignment features of the imaging units with the frame.
Figure 39:
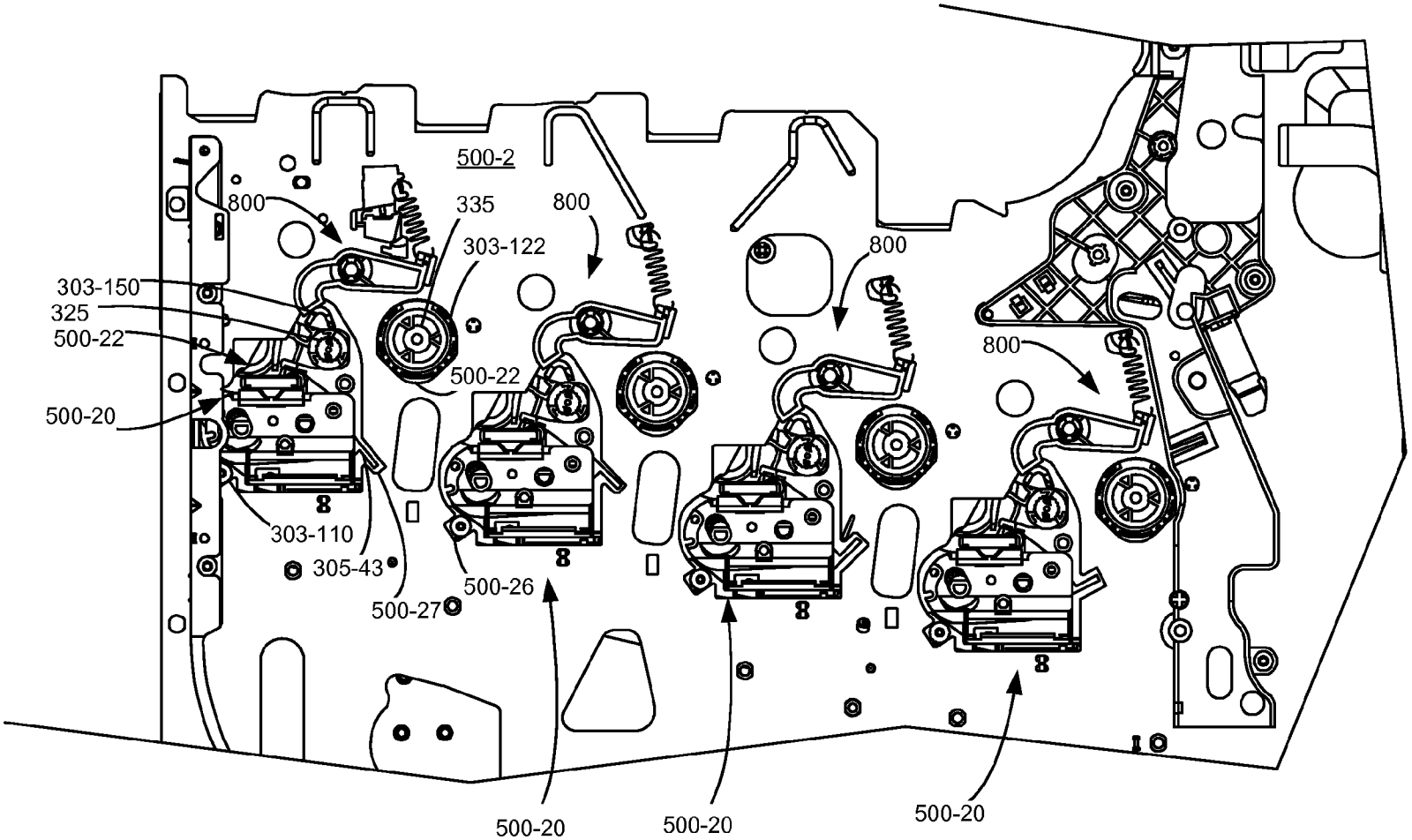
FIG. 39 is a partial rear view of the frame of FIG. 36 illustrating the engagement of alignment features of the imaging units with the frame.

FIGS. 38-39 illustrate the cooperative engagement between imaging units 300 and door plate 701 on front panel 500-1 and rear panel 500-2. Bell crank assemblies, generally designated by reference number 800, are provided on door plate 701 and rear panel 500-2. As shown four assemblies are provided on door plate 701 and rear panel 500-2. The four pairs of bell crank assemblies 800, as explained below, cooperate with the alignment features provided on the first and second end caps 303-100, 300-101 so that each imaging unit 300 is properly oriented in space with relation to intermediate transfer member 190 and the laser beam 113. Intermediate transfer member 190 would be positioned in frame 500 on top of the four imaging units 300. A pair of bell crank assemblies 800 is provided for each imaging unit 300. For each installed imaging unit 300, its respective pair of bell crank assemblies 800 provides a rotational force causing that imaging unit 300 to rotate slightly about an axis of rotation between second bullets noses 303-120, 303-122 or about the axis of rotation of PC drum 310. The respective first bullet noses 303-110 rotate slightly due to the supplied force and seat against respective alignment openings provided in door plate 701 and rear panel 500-2. This aids with the alignment of window 303-18 to the path of the laser beam 113.

Figure 40:
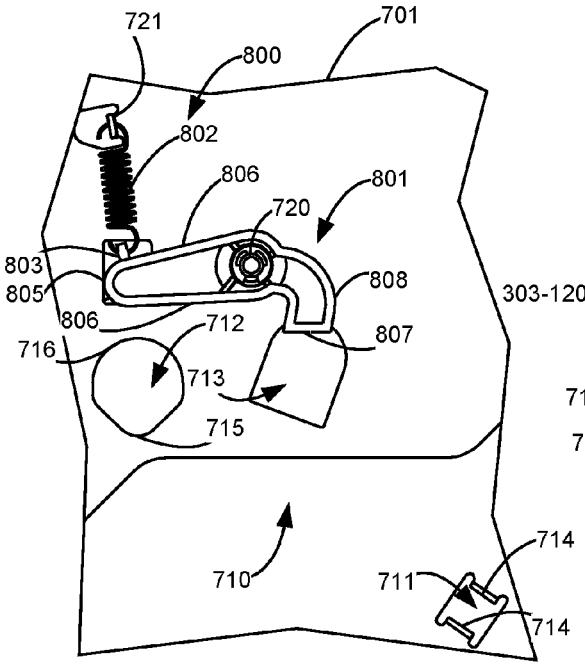
FIG. 40 is a partial enlarged view of alignment openings provided on the front of the frame.
Figure 41:
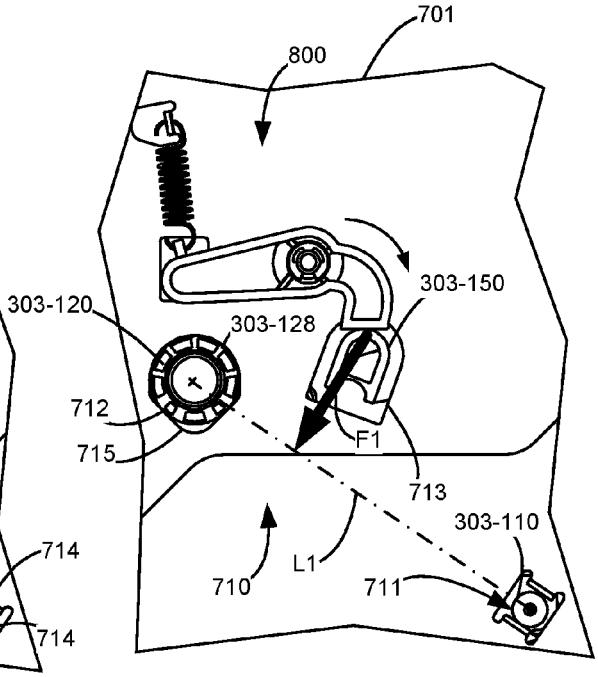
FIG. 41 is a partial enlarged view showing the engagement of alignment features of the imaging unit engaged with the alignment openings provided on the front of the frame.
Figure 42:
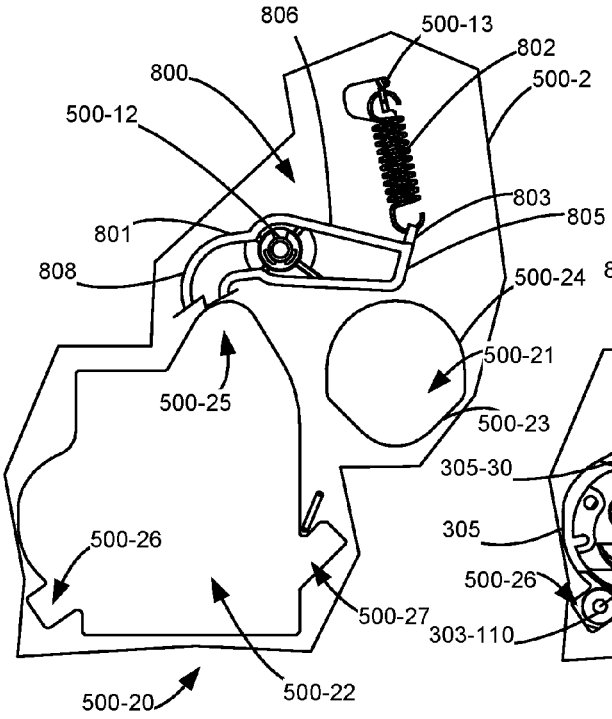
FIG. 42 is a partial enlarged view of alignment openings provided on the rear of the frame.
Figure 43:
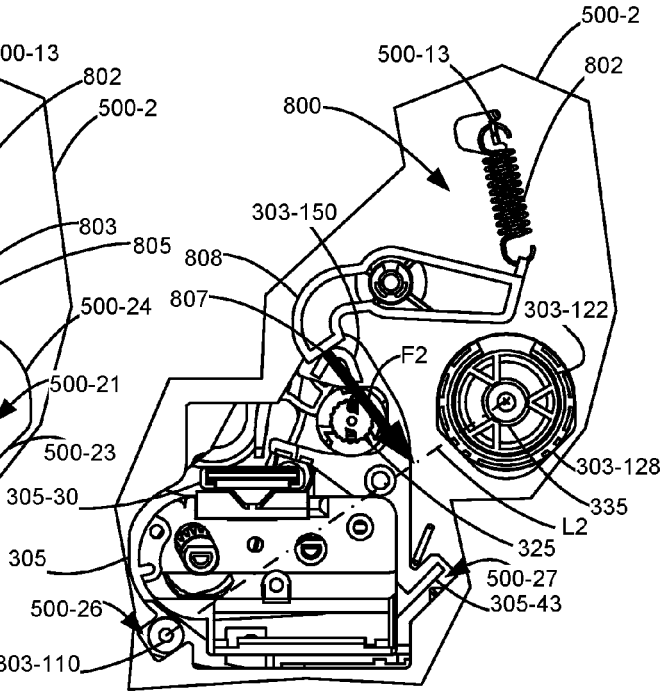
FIG. 43 is a partial enlarged view showing the engagement of alignment features of the imaging unit engaged with the alignment openings provided on the rear of the frame.

Door plate 701 has four substantially identical sets of alignment openings, generally designated 710, and rear panel 500-2 has four substantially identical sets of alignment openings 500-20. FIGS. 40-41 provide an enlarged detail of one set of openings 710 without an imaging unit 300 installed and then with an imaging unit 300 installed. FIGS. 42-43 provide an enlarged detail of one set of openings 500-20 without and with the same imaging unit 300 shown in FIGS. 40-41. For each set of openings 710 there is a corresponding aligned set of openings 500-20. For each imaging unit 300, door plate 701 has three openings of interest first bullet nose opening 711, second bullet nose opening 712, and stop arm opening 713. Rear panel 500-2 is shown having two openings of interest second bullet nose opening 500-21 that is functionally the same as second bullet nose opening 712 and drive opening 500-22, which provides multiple positioning features.

First bullet nose opening 711, shown in the lower right portion of FIGS. 40-41, receives first bullet nose 303-110 on first end cap 303-100. One or more datum surfaces 714 may be provided in opening 711. Second bullet nose opening 7112 has a V-shaped lower portion 715 and a circular upper portion 716. The angled sides of the V-shaped portion 715 provide opposed surfaces for second bullet nose 303-120 on first end cap 303-100. Similarly, in FIGS. 42-43, second bullet nose opening 500-21 has a V-shaped lower portion 500-23 and a circular upper portion 500-24. The angled sides of V-shaped portion 500-23 of second bullet nose opening 500-21 provide opposed surfaces for second bullet nose 303-122 on second end cap 303-101. Second bullet nose openings 712 and 500-21 are aligned with one another. As shown ribs 303-128 on each of second bullet noses 303-120, 303-122 are supported by their respective V-shaped portions 715, 500-23 establishing datum points to fix the location of the axis of rotation of PC drum 310 in frame 500.

Drive opening 500-22 is an irregular multipurpose opening. Drive opening 500-22 allows circuit board and connector assembly 375 to engage with a corresponding connector in image forming device 100 and drive coupler 325 on developer unit 305 to engage with a corresponding drive source in image forming device 100. Also toner inlet 305-30 extends through drive opening 500-22 where it will be supplied with toner, via an interconnecting chute, from a corresponding toner cartridge positioned above. Drive opening 500-22 is provided with an arcuate cutout 500-25 adjacent its top (a portion of bell crank assembly 800 has been removed to illustrate this) to allow for stop arm 303-150 to pass through and a rectangular or squared off notch 500-26 in the lower left corner for seating first bullet nose 303-110 on second end cap 303-101. Drive opening 500-22 has another angled notch, keying notch 500-27, positioned opposite to notch 500-26 and used to accept or block keying member 305-43. The angle of keying notch 500-27 and keying member 305-43 changes for each color of toner. In FIG. 39, the toner colors, from left to right, are yellow, cyan, magenta, and black with keying notch 500-27 and keying member 305-43 for each color have different angular orientations. Only imaging units 300 having keying members 305-43 with an angle corresponding to that of keying notch 500-27 will seat correctly allowing door assembly 700 to be closed and latched.

Because all eight bell crank assemblies 800 are substantially identical, only one will be described in detail. With imaging unit 300 installed in frame 500 and door assembly 700 closed, bell crank assemblies 800 on door plate 701 and rear panel 500-2 provide rotation forces F1 and F2 to stop arms 303-150 as shown in FIGS. 41 and 43. As shown force F1 is applied in a direction substantially perpendicular to line L1 that is drawn through the centers of first bullet nose 303-110 and second bullet nose 303-120 while force F2 is applied in a direction substantially perpendicular to line L2 that is drawn through the centers of first bullet nose 303-110 and second bullet nose 303-122.

Referring to FIGS. 40-41, 43, bell crank assembly 800 comprises a crank arm 8011 and a spring 802. Crank arm 801 is L-shaped or 1-shaped and is mounted on a pivot 720 provided on plate 701. Spring 802 is connected to a mount 721 provided on plate 701 and to a mount 803 provided at a free end 805 of straight portion 806 of crank arm 801. Similarly on rear panel 500-2, a pivot 500-12 is provided for crank arm 801, and spring mount 500-13 and a mount 803 is provided at free end 805 of straight portion 806 of crank arm 801 is provided for spring 802. Spring 802 rotates crank arm 801 in a downward direction as viewed in FIGS. 41 and 43. The free ends 807 of J-shaped portions 808 of crank arms 801 apply this torque to stop arms 303-150 as previously described.

Figure 44:
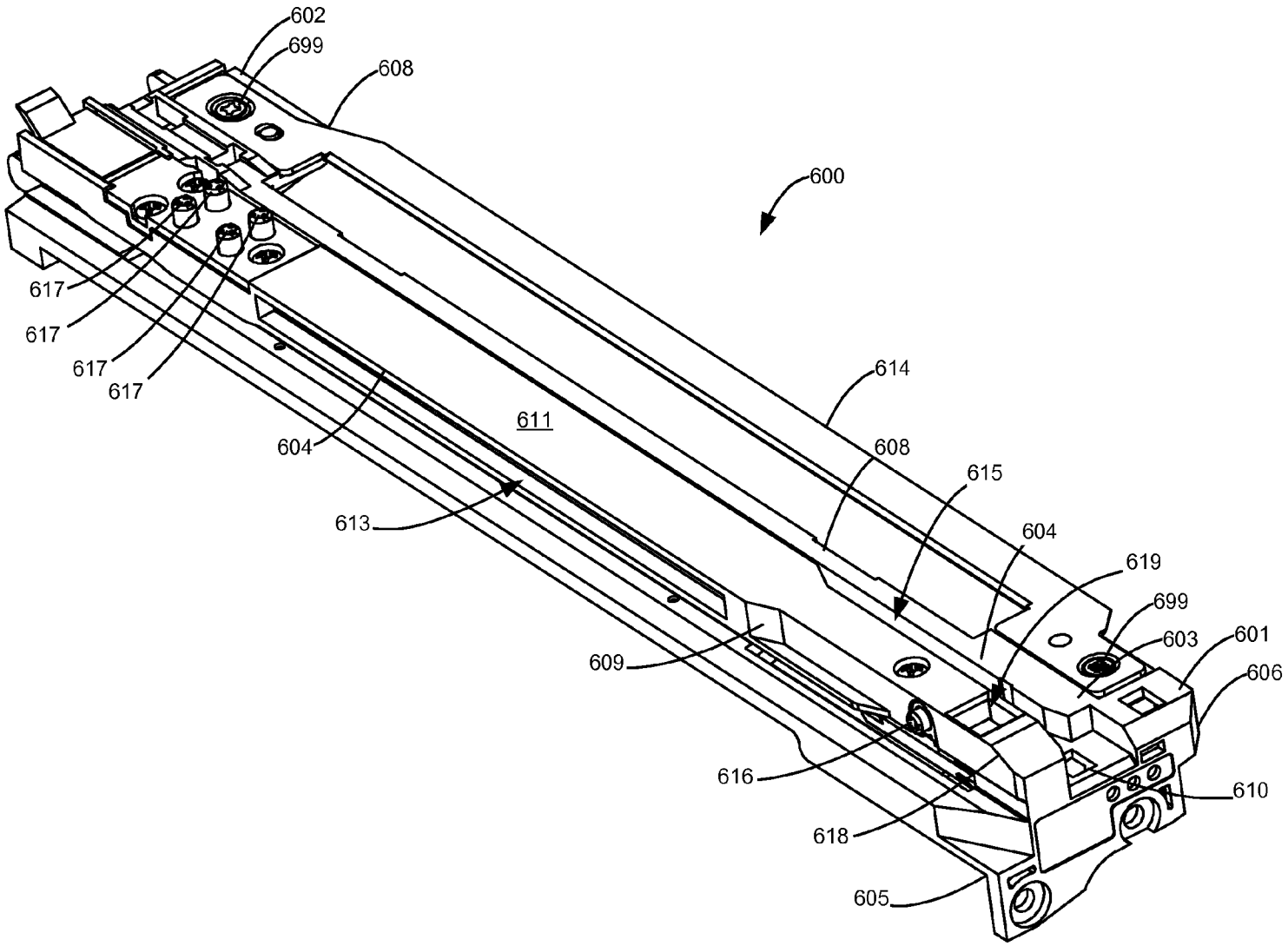
FIG. 44 is a perspective view of a rail assembly used in the frame.
Figure 45:
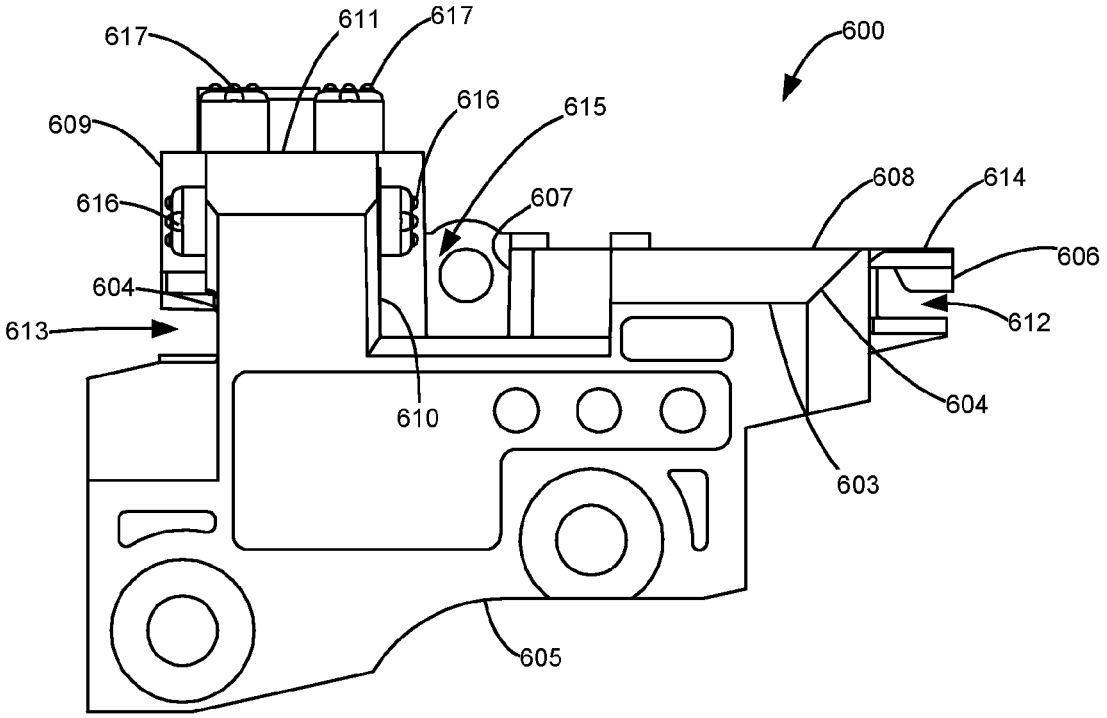
FIG. 45 is an end view of the rail assembly of FIG. 44.

Referring now to FIGS. 31-33 and 44-45, the alignment features provide on bottom plate 303-13 and on first end cap 303-100 will be described. As shown in FIG. 44, a first end 601 and a second end 602 of rail assembly 600 would be fastened to front and rear panels 500-1, 500-2, respectively. First and second parallel rails 603, 604 extend along the length of base 605 of rail assembly 600. First rail 603 has outer, inner and top sides 606, 607, 608 while second rail 604 has outer, inner and top sides 609, 610, 611. As shown guide slots 612, 613 are provided along the outer sides 606, 609 of first and second rails 603, 604. As illustrated, a portion of the outer and top sides 606, 608 of first rail 603 is formed by member 614 affixed to the first and second ends 601, 602 of first rail 603 by fasteners 699. Channel 615 is formed between first and second rails 603, 604.

First rail 603 is sized to be received in first channel 303-16 of PC unit 303 while second rail 604 is sized to be received in second channel 303-17 thereof. Wall 300-20 of first channel 303-16 and wall 300-24 of second channel 303-17 are received in channel 615. The widths of first rail 603 and first channel 303-16 are different from those of second rail 604 and second channel 303-17 to insure that imaging unit 300 is inserted into frame 500 in the correct orientation. A pair of side contacts 616 is provided on the outer and inner sides 609, 610 of second rail 604 adjacent first end 601 and engage with contacts 397 in second channel 303-17 of imaging unit 300, when installed. A plurality of surface contacts 617, four are shown, are provided on top surface 611 of second rail 604 adjacent second end 602 and, when imaging unit 300 is installed, engage with contacts 398 of processing circuitry 301 mounted in second channel 303-17. An upwardly ramping surface 618 is provided at first end 601 of second rail 604 and extends toward a latch hole 619 provided in top surface 612 just inward of ramping surface 613.

Imaging unit 300 is inserted at second end 300-2 first onto the first end 601 of rail assembly 600. Ramp 303-29 of second channel 303-17 slides over and up ramping surface 618 of second rail 604 and first rail enters first channel 303-16. As insertion of imaging unit 300 continues, guide slots 612, 613 would engage with inwardly extending lips 303-27 provided in first and second channels 303-16, 303-17 as imaging unit 300 is inserted. As ramp 303-29 encounters surface contacts 617, the second end 300-2 of imaging unit 300 elevates slightly to reduce insertion force required to move across surface contacts 617 on second rail 604. When imaging unit 300 is seated, surface contacts 617 engage with contacts 398 on processing circuitry 301. At this point, first end 300-1 of imaging unit 300 is nearing first end 601 of rail assembly 600. The insertion end 362 of latch arm 360 of handle assembly 349 rides up ramping surface 618 and is raised vertically, counter to the biasing force provided by bias spring 365 in handle assembly 349. When insertion end 362 clears the front of latch hole 619, the force of bias spring 365 snaps latch arm 360 into latch hole 619, to prevent imaging unit 300 from ejecting forward due to forces applied to drive couplers 325, 335 and those from shutter spring 348. At this point the second end 300-2 of imaging unit 300 is adjacent to rear panel 500-2 and first bullet nose 303-110, stop arm 303-150 and second bullet nose 303-122 on second end cap 303-101 are received into square notch 500-26, arcuate cutout 500-25 and second bullet nose opening 500-21, respectively on rear panel 500-2. This is repeated for each imaging unit 300 needed. Door assembly 700 is then rotated up to its closed position during which time first bullet nose 303-110, stop arm 303-150 and second bullet nose 303-120 on first end cap 303-100 are received into first bullet nose opening 711, second bullet nose opening 712 and stop arm opening 713 on plate of door assembly. Latches 704 snap engage with front panel 501 as previously described. Aligned openings 730 are provide in door plate 701 and cover 702 to allow waste toner exit port 303-46 to extend outside of door assembly 700 and into a waste toner bottle (not shown). Opening 740 may also be provided in cover 702 aligned with each of first and second bullet nose openings 711, 712 to allow first and second bullet noses 303-110, 303-120 on first end cap 303-100 to be visible.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. A replaceable unit for an image forming device, comprising:

a frame having a generally rectangular bottom plate and a first and second end plate attached adjacent to respective first and second ends of the bottom plate, the first and second end plates rotatably supporting therebetween a shaft axially extending from each end of a roll and centered on the rotational axis of the roll;

a first and a second end cap removably attached to the respective first and second end plates forming a first and a second end wall, each end cap having a first bullet nose, a second bullet nose and a stop arm each axially projecting from an outer surface thereof and positioned between the first and second bullet noses;

the second bullet noses being axially aligned with one another and having respective aligned openings therein to rotatably receive the shaft and align the rotational axis of the roll with the centers of the second bullet noses; and the first bullet noses of the first and second end caps being in respective axial alignment parallel to the rotational axis of the roll, wherein the first and second bullet noses of the first and second end caps are slidably receivable into corresponding first and second openings in a frame of the image forming device for axially and radially positioning of the replaceable unit in the image forming device, and, further wherein, when the replaceable unit is installed in the frame of the image forming device each stop arm on the first and second end caps receives a respective biasing force for biasing the respective first and second bullet noses into contact with a respective support surface provided in the respective corresponding first and second openings in the frame of the image forming device.

2. The replaceable unit of claim 1 wherein each stop arm on each end cap is positioned so that the biasing force, when applied to each stop arm, is in a direction substantially perpendicular to a line drawn between the first and second bullet noses of each respective end cap.

3. The replaceable unit of claim 1 wherein each axial opening in each of the second bullet noses has a bearing fixed therein to receive the shaft extending from the corresponding end of the roll, each bearing centered about the rotational axis of the roll.

4. The replaceable unit of claim 1 wherein an exterior surface of the second bullet nose of the second end cap has a plurality of circumferentially spaced ribs.

5. The replaceable unit of claim 1 wherein the axial opening in the second bullet nose of the second end cap extends therethrough allowing the corresponding shaft of the roll to extend therethrough for mounting a drive coupler thereon, the drive coupler when mounted being recessed into the axial opening in the second bullet nose of the second end cap.

6. The replaceable unit of claim 5 wherein a wall of the second bullet nose of the second end cap has a slot therein extending between an exterior surface of the second bullet nose of the second end cap and the axial opening, the slot extending axially from an outer end of the second bullet nose of the second end cap to a point behind a mounting location of the drive coupler on the corresponding shaft of the roll.

7. The replaceable unit of claim 1 wherein each end plate further comprises a first boss and a second boss axially extending from the outer surface thereof and parallel to one another, the first boss being received in an axially aligned opening on an inner surface of the corresponding end cap and the second boss being received in an axially aligned opening in the first bullet nose.

8. The replaceable unit of claim 1 wherein the top surface of the bottom plate further includes a first support member and a second support member mounted thereon and positioned inward from the first and second end plates, respectively, the first support member and second support member each further having a back wall having a height lower than a corresponding top planar surface substantially parallel to the bottom plate thereof with a ramping surface interconnecting a top of the back wall to an end of the top planar surface, wherein the top planar surface of one of the first and second support members forms a rotational stop and a datum surface for a detachable unit insertable into the frame when the detachable unit is inserted into the replaceable unit.

9. The replaceable unit of claim 8 wherein:

the first and second end wall each have a channel therein and aligned with one another, one channel of the first and second end walls having at least one second datum surface formed therein and the other channel of the first and second end walls having a deskewing plug positioned to form an end thereof, wherein each channel is sized to receive a corresponding positioning bearing mounted on a shaft of the roll rotatably mounted on the detachable unit, one of the positioning bearings engaging with the at least one second datum surface, and, the other positioning bearing abutting the deskewing plug when the detachable unit is attached to the replaceable unit; and a spring-biased latch mounted on each of the first and second end walls adjacent to an entry end of each channel, the spring-biased latch of the first end wall engageable with a corresponding one of the positioning bearings with the spring-biased latch of the second end wall engageable with the other one of the positioning bearings wherein, each of the spring-biased latches, when in a closed position, applies a respective force to the corresponding positioning bearings with one of the positioning bearings being in contact with the at least one second datum surface and the other of the positioning bearings being in contact with the deskewing plug.

10. The replaceable unit of claim 9 wherein the deskewing plug has a first portion having a cylindrical shape received into a corresponding opening in the other of the first and second end walls and a second cylindrical portion having a circumferential camming surface, the camming surface being engageable with the corresponding positioning bearing, wherein, with the detachable unit attached, rotation of the deskewing plug and the camming surface against the corresponding positioning bearing adjusts the axial alignment between respective rotational axes of the roll in the replaceable unit and the roll in the detachable unit.

11. The replaceable unit of claim 10 wherein the mounting channel of the second end plate has the at least one second datum surface, and the deskewing plug is rotatably mounted in the first end wall.

12. The replaceable unit of claim 11 wherein the mounting channel of the second end wall further includes a third datum surface positioned transverse to the at least one second datum surface, the third datum surface contacting the corresponding positioning bearing when the detachable unit is attached.

13. The replaceable unit of claim 8 further comprising:

the top surface of the bottom plate having a latching channel, the latching channel extending toward the first and second end plates with the first and second support members being mounted in a bottom of the latching channel; and a spring biased latching bar pivotally mounted in the latching channel, the latching bar having a first catch and a second catch positioned adjacent the first and second support members, the latching bar further having a release arm extending from the latching bar to an adjacent front edge of the bottom plate, wherein, the latching bar and first and second catches are biased upward from the bottom of the latching channel when the detachable unit is uninstalled, and, when the detachable unit is being installed, the latching bar and first and second catches are rotated toward the bottom of the latching channel by the detachable unit, and, when the detachable unit has engaged the rotational stop on one of the first and second support members, the first and second catches cooperatively engage with corresponding engagement features on the detachable unit to hold the detachable unit in engagement with the replaceable unit, and, further wherein, with the detachable unit engaged both the detachable unit and replaceable unit can be lifted using a handle on the detachable unit, and, upon rotation of the release arm toward the bottom plate, the first and second catches are released allowing the detachable unit to be disengaged from the replaceable unit.

14. A replaceable unit for an image forming device, comprising:

a frame having a generally rectangular bottom plate and a first and a second end plate attached adjacent to respective first and second ends of the bottom plate, the first and second end plates rotatably supporting therebetween a shaft axially extending from each end of a photoconductive drum and centered on the rotational axis of the photoconductive drum;

a top surface of the bottom plate including a first support member and a second support member positioned inward from the first and second end plates, respectively, a top planar surface of the second support member being a first datum surface and rotational stop for a detachable unit insertable between the first and second end plates;

a first and a second end cap removably attached to the respective first and second end plate, each end cap having a multiplicity of alignment features axially projecting from an outer surface thereof;

the first and second end plates having a C-shaped mounting channel aligned with one another, the mounting channel in the first end plate having a deskewing plug positioned adjacent an internal end thereof and the mounting channel in the second end plate having a plurality of datum surfaces formed therein, the first and second mounting channels each sized to receive a first and a second positioning bearing, respectively, mounted on a shaft of a roll rotatably mounted on the detachable unit, the first positioning bearing engaging with the deskewing plug and the second positioning bearing engaging with the plurality of datum surfaces when the detachable unit is attached to the replaceable unit; and, a first spring-biased latch and a second spring-biased latch each pivotally mounted adjacent a respective mouth of the first and second mounting channels, the first and second spring-biased latches engageable with the first and second positioning bearings, respectively, wherein, each of the spring-biased latches of the first and second end caps when engaged applies a force to the first and second positioning bearings, respectively, to hold the first and second positioning bearings in contact with the deskewing plug and the plurality of datum surfaces, respectively.

15. The replaceable unit of claim 14 wherein the deskewing plug has a first portion having a cylindrical shape received into a corresponding opening in the first end cap and a second portion having a camming surface, the camming surface being engageable with the first positioning bearing, wherein with the detachable unit attached, rotation of the deskewing plug and the camming surface against the first positioning bearing allows the axial alignment between respective rotational axes of the photoconductor drum and the roll in the detachable unit to be deskewed.

16. The replaceable unit of claim 14 wherein the plurality of alignment features on the first and second end caps further comprise:

a first bullet nose, a second bullet nose and a stop arm each axially projecting from an outer surface thereof with the stop arm positioned between the first and second bullet noses;

the second bullet noses each having an axially aligned opening therein for receiving the respective shaft extending from each end of the photoconductive drum and aligning the rotational axis of the photoconductor drum with the centers of the second bullet noses;

the first bullet noses of the first and second end caps being in respective axial alignment parallel to the rotational axis of the photoconductor drum, wherein the first and second bullet noses are slidably receivable into corresponding first and second openings in a frame of the image forming device for axially and radially positioning of the replaceable unit in the image forming device, and further wherein, when the replaceable unit is installed in the frame of the image forming device each stop arm on the first and second end caps receives a respective biasing force for biasing the respective first and second bullet noses into contact with a respective support surface provided in the respective corresponding first and second openings in the frame of the image forming device.

17. The replaceable unit of claim 16 wherein each stop arm on each end cap is positioned so that the biasing force, when applied to each stop arm, is in a direction substantially perpendicular to a line drawn between the first and second bullet noses of each respective end cap.

18. The replaceable unit of claim 16 wherein each axial opening in each of the second bullet noses has a bearing fixed therein to receive the shaft extending from the corresponding end of the photoconductive drum, each bearing centered about the rotational axis of the photoconductive drum.

19. The replaceable unit of claim 16 wherein the axial opening in the second bullet nose of the second end cap extends therethrough allowing the corresponding shaft on the end of the photoconductor drum to extend therethrough for removably mounting a drive coupler thereon, the drive coupler when mounted being recessed into the axial opening in the second bullet nose of the second end cap.

20. The replaceable unit of claim 19 where a wall of the second bullet nose of the second end cap has a slot therein extending between an exterior surface of the first bullet nose of the second end cap and the axial opening therein, the slot extending axially from an outer end of the second bullet nose of the second end cap to a point behind a mounting location of the drive coupler on the corresponding shaft of the photoconductor drum.

21. The replaceable unit of claim 19 wherein each end plate further comprises a first boss and a second boss axially extending from the outer surface thereof and being substantially parallel to one another, the first boss being positioned adjacent and parallel to the respective shafts of the photoconductive drum and being received in an axially aligned opening on an inner surface of the corresponding end cap and the second boss being received in an axially aligned opening in the second bullet nose.

* * * * *